US009114275B2

(12) United States Patent
Lu et al.

(10) Patent No.: US 9,114,275 B2
(45) Date of Patent: Aug. 25, 2015

(54) EXERCISE ASSEMBLIES HAVING CRANK MEMBERS WITH LIMITED ROTATION

(71) Applicant: Brunswick Corporation, Lake Forest, IL (US)

(72) Inventors: Zhi Lu, Glenview, IL (US); Thomas J. Danowski, Shaumburg, IL (US); Mark C. Termion, Winfield, IL (US)

(73) Assignee: Brunswick Corporation, Lake Forest, IL (US)

( * ) Notice: Subject to any disclaimer, the term of this patent is extended or adjusted under 35 U.S.C. 154(b) by 64 days.

(21) Appl. No.: 14/095,368

(22) Filed: Dec. 3, 2013

(65) Prior Publication Data

US 2014/0249000 A1 Sep. 4, 2014

Related U.S. Application Data

(63) Continuation-in-part of application No. 14/047,448, filed on Oct. 7, 2013, and a continuation-in-part of application No. 13/783,610, filed on Mar. 4, 2013.

(51) Int. Cl.

| | |
|---|---|
| ***A63B 22/00*** | (2006.01) |
| ***A63B 21/00*** | (2006.01) |
| *A63B 22/06* | (2006.01) |

(52) U.S. Cl.

CPC ..... *A63B 22/0064* (2013.01); *A63B 21/154* (2013.01); *A63B 22/001* (2013.01); *A63B 2022/0682* (2013.01)

(58) Field of Classification Search

USPC ..... 482/1–148

See application file for complete search history.

(56) References Cited

U.S. PATENT DOCUMENTS

| | | | |
|---|---|---|---|
| 321,388 | A | 6/1885 | Ruebsam |
| 652,612 | A | 6/1900 | Harrison |
| 663,486 | A | 12/1900 | Boren |
| 881,521 | A | 3/1908 | Wilson |
| 931,394 | A | 8/1909 | Day |
| 1,020,777 | A | 3/1912 | Peterson |
| 1,715,870 | A | 6/1929 | Spain |
| 1,850,530 | A | 3/1932 | Brown |
| 1,902,694 | A | 3/1933 | Edwards |

(Continued)

FOREIGN PATENT DOCUMENTS

| | | |
|---|---|---|
| CA | 2064657 | 10/1993 |
| DE | 83466 | 4/1895 |

(Continued)

OTHER PUBLICATIONS

International Search Report and Written Opinion, PCT/US2014/013821, mailed May 21, 2014.

(Continued)

*Primary Examiner* — Stephen Crow

(74) *Attorney, Agent, or Firm* — Andrus Intellectual Property Law, LLP

(57) ABSTRACT

An exercise assembly has a frame, a pair of elongated foot pedal members, a pair of elongated coupler arms, a pair of crank members, a pair of elongated rocker arms, and a front cross-shaft. The pair of foot pedal members are each movable along user-defined paths of different dimensions. Each crank member is rotatable in a circular path and is freely rotatable along the circular path in a first direction and restrained from rotation along the circular path in a second, opposite direction.

20 Claims, 17 Drawing Sheets

(56) References Cited

U.S. PATENT DOCUMENTS

| | | | |
|---|---|---|---|
| 1,928,089 | A | 9/1933 | Blickman |
| 1,973,945 | A | 9/1934 | Chavin et al. |
| 2,453,771 | A | 11/1948 | White et al. |
| 2,648,330 | A | 8/1953 | Clark |
| 2,855,200 | A | 10/1958 | Blickman |
| 3,127,171 | A | 3/1964 | Noland et al. |
| D207,541 | S | 5/1967 | Hesen |
| 3,378,259 | A | 4/1968 | Kupchinski |
| D211,801 | S | 7/1968 | Quinton |
| 3,444,830 | A | 5/1969 | Doetsch |
| 3,563,541 | A | 2/1971 | Sanquist |
| 3,586,322 | A | 6/1971 | Kverneland |
| 3,589,715 | A | 6/1971 | Mark |
| 3,614,097 | A | 10/1971 | Blickman |
| 3,642,279 | A | 2/1972 | Cutter |
| 3,659,845 | A | 5/1972 | Quinton |
| 3,731,917 | A | 5/1973 | Townsend |
| 3,741,538 | A | 6/1973 | Lewis et al. |
| 3,745,990 | A | 7/1973 | Neis |
| 3,756,595 | A | 9/1973 | Hague |
| 3,758,111 | A | 9/1973 | Agamian |
| 3,824,993 | A | 7/1974 | Grant |
| 3,874,657 | A | 4/1975 | Niebojewski |
| 3,918,710 | A | 11/1975 | Niebojewski |
| 3,966,201 | A | 6/1976 | Mester |
| 4,026,545 | A | 5/1977 | Schonenberger |
| 4,066,257 | A | 1/1978 | Moller |
| 4,185,622 | A | 1/1980 | Swenson |
| 4,235,437 | A | 11/1980 | Ruis et al. |
| 4,248,476 | A | 2/1981 | Phelps |
| 4,300,761 | A | 11/1981 | Howard |
| 4,383,714 | A | 5/1983 | Ishida |
| 4,422,635 | A | 12/1983 | Herod et al. |
| 4,436,097 | A | 3/1984 | Cunningham |
| 4,519,604 | A | 5/1985 | Arzounian |
| 4,576,377 | A | 3/1986 | Wolff |
| 4,625,962 | A | 12/1986 | Street |
| 4,664,646 | A | 5/1987 | Rorabaugh |
| 4,666,173 | A | 5/1987 | Graham |
| 4,679,787 | A | 7/1987 | Guilbault |
| 4,757,987 | A | 7/1988 | Allemand |
| 4,786,050 | A | 11/1988 | Geschwender |
| 4,805,901 | A | 2/1989 | Kulick |
| 4,826,153 | A | 5/1989 | Schalip |
| 4,842,269 | A | 6/1989 | Huang |
| 4,846,156 | A | 7/1989 | Kopnicky |
| 4,872,669 | A | 10/1989 | Henry |
| 4,881,732 | A | 11/1989 | Kepiro |
| 4,905,330 | A | 3/1990 | Jacobs |
| 4,913,396 | A | 4/1990 | Dalebout et al. |
| 4,913,423 | A | 4/1990 | Farran et al. |
| 4,921,247 | A | 5/1990 | Sterling |
| 4,938,474 | A | 7/1990 | Sweeney et al. |
| 4,974,831 | A | 12/1990 | Dunham |
| 4,998,725 | A | 3/1991 | Watterson et al. |
| 5,002,271 | A | 3/1991 | Gonzales |
| 5,029,801 | A | 7/1991 | Dalebout et al. |
| 5,058,881 | A | 10/1991 | Measom |
| 5,102,380 | A | 4/1992 | Jacobson et al. |
| 5,108,092 | A | 4/1992 | Hurst |
| 5,109,778 | A | 5/1992 | Berkowitz et al. |
| 5,110,117 | A | 5/1992 | Fisher et al. |
| 5,121,654 | A | 6/1992 | Fasce |
| 5,184,988 | A | 2/1993 | Dunham |
| 5,186,697 | A | 2/1993 | Rennex |
| 5,192,255 | A | 3/1993 | Dalebout et al. |
| 5,199,931 | A | 4/1993 | Easley et al. |
| 5,207,622 | A | 5/1993 | Wilkinson et al. |
| 5,207,628 | A | 5/1993 | Graham |
| 5,242,343 | A | 9/1993 | Miller |
| 5,279,529 | A | 1/1994 | Eschenbach |
| 5,282,776 | A | 2/1994 | Dalebout |
| 5,295,928 | A | 3/1994 | Rennex |
| 5,299,992 | A | 4/1994 | Wilkinson |
| 5,352,167 | A | 10/1994 | Ulicny |
| 5,352,169 | A | 10/1994 | Eschenbach |
| 5,372,559 | A | 12/1994 | Dalebout et al. |
| 5,383,829 | A | 1/1995 | Miller |
| 5,423,729 | A | 6/1995 | Eschenbach |
| 5,429,563 | A | 7/1995 | Engel et al. |
| 5,441,467 | A | 8/1995 | Stevens |
| 5,452,910 | A | 9/1995 | Harris |
| 5,453,066 | A | 9/1995 | Richter, Jr. |
| 5,518,473 | A | 5/1996 | Miller |
| 5,529,554 | A | 6/1996 | Eschenbach |
| 5,529,555 | A | 6/1996 | Rodgers, Jr. |
| 5,536,225 | A | 7/1996 | Neuberg et al. |
| 5,540,637 | A | 7/1996 | Rodgers, Jr. |
| 5,549,526 | A | 8/1996 | Rodgers, Jr. |
| 5,562,574 | A | 10/1996 | Miller |
| 5,573,480 | A | 11/1996 | Rodgers, Jr. |
| 5,577,985 | A | 11/1996 | Miller |
| 5,611,756 | A | 3/1997 | Miller |
| 5,616,111 | A | 4/1997 | Randolph |
| 5,626,538 | A | 5/1997 | Dalebout et al. |
| 5,637,058 | A | 6/1997 | Rodgers, Jr. |
| 5,692,994 | A | 12/1997 | Eschenbach |
| 5,735,774 | A | 4/1998 | Maresh |
| 5,879,271 | A | 3/1999 | Stearns et al. |
| 5,893,820 | A | 4/1999 | Maresh et al. |
| 5,895,339 | A | 4/1999 | Maresh |
| 5,935,046 | A | 8/1999 | Maresh |
| 5,947,872 | A | 9/1999 | Ryan et al. |
| 6,042,515 | A | 3/2000 | Wang |
| 6,045,487 | A | 4/2000 | Miller |
| 6,084,325 | A | 7/2000 | Hsu |
| 6,110,076 | A | 8/2000 | Hurt |
| 6,135,925 | A | 10/2000 | Liu |
| 6,142,915 | A | 11/2000 | Eschenbach |
| 6,168,552 | B1 | 1/2001 | Eschenbach |
| 6,183,397 | B1 | 2/2001 | Stearns et al. |
| 6,183,398 | B1 | 2/2001 | Rufino et al. |
| 6,206,804 | B1 | 3/2001 | Maresh |
| 6,206,806 | B1 | 3/2001 | Chu |
| 6,248,044 | B1 | 6/2001 | Stearns et al. |
| 6,390,953 | B1 | 5/2002 | Maresh et al. |
| 6,482,132 | B2 | 11/2002 | Eschenbach |
| 6,544,146 | B1 | 4/2003 | Stearns et al. |
| 6,648,800 | B2 | 11/2003 | Stearns et al. |
| 6,689,020 | B2 | 2/2004 | Stearns et al. |
| 6,846,273 | B1 | 1/2005 | Stearns et al. |
| 6,855,093 | B2 | 2/2005 | Anderson et al. |
| RE38,803 | E | 9/2005 | Rodgers, Jr. |
| 7,060,005 | B2 | 6/2006 | Carlsen et al. |
| 7,112,161 | B2 | 9/2006 | Maresh |
| 7,153,239 | B1 | 12/2006 | Stearns et al. |
| 7,175,568 | B2 | 2/2007 | Eschenbach |
| 7,344,480 | B2 | 3/2008 | Maresh et al. |
| 7,479,093 | B1 | 1/2009 | Immordino et al. |
| 7,485,072 | B2 | 2/2009 | Chuang |
| 7,494,447 | B2 | 2/2009 | Eschenbach |
| 7,520,839 | B2 | 4/2009 | Rodgers, Jr. |
| 7,530,926 | B2 | 5/2009 | Rodgers, Jr. |
| 7,625,317 | B2 | 12/2009 | Stevenson et al. |
| 7,682,288 | B1 | 3/2010 | Stearns et al. |
| 7,717,833 | B1 | 5/2010 | Nelson et al. |
| 7,736,278 | B2 * | 6/2010 | Lull et al. ..... 482/52 |
| 7,771,324 | B2 | 8/2010 | Anderson et al. |
| 7,828,698 | B2 | 11/2010 | Rodgers, Jr. |
| 7,841,968 | B1 * | 11/2010 | Eschenbach ..... 482/52 |
| 7,887,465 | B2 | 2/2011 | Uffelman |
| 7,918,766 | B2 | 4/2011 | Lu et al. |
| 7,931,566 | B1 | 4/2011 | Radke et al. |
| 8,105,213 | B2 | 1/2012 | Stewart |
| 8,272,997 | B2 | 9/2012 | Anderson et al. |
| 2002/0094914 | A1 | 7/2002 | Maresh et al. |
| 2005/0049117 | A1 | 3/2005 | Rodgers et al. |
| 2005/0181911 | A1 | 8/2005 | Porth |
| 2005/0202939 | A1 | 9/2005 | Lull et al. |
| 2005/0250621 | A1 | 11/2005 | Corbalis et al. |
| 2005/0277516 | A1 | 12/2005 | Girard et al. |
| 2007/0179023 | A1 | 8/2007 | Dyer |
| 2008/0242516 | A1 | 10/2008 | Lu et al. |

(56) References Cited

U.S. PATENT DOCUMENTS

| | | | |
|---|---|---|---|
| 2009/0156369 | A1 | 6/2009 | Rodgers, Jr. |
| 2012/0058862 | A1 | 3/2012 | Anderson et al. |
| 2012/0289380 | A1 | 11/2012 | Chen |

FOREIGN PATENT DOCUMENTS

| | | |
|---|---|---|
| DE | 2 225 342 | 5/1972 |
| DE | 24 08 052 | 2/1974 |
| DE | 4404831 | 12/1994 |
| GB | 1 169 148 | 10/1969 |
| GB | 1 326 263 | 8/1973 |
| GB | 1348716 | 3/1974 |
| GB | 1 505 702 | 3/1978 |
| GB | 2 120 560 | 12/1983 |
| JP | 56-56358 | 5/1981 |
| JP | 56-150562 | 11/1981 |

OTHER PUBLICATIONS

International Search Report and Written Opinion, PCT/US2014/013817, mailed May 21, 2014.

International Search Report and Written Opinion, PCT/US2014/013820, date of mailing May 12, 2014.

* cited by examiner

EXERCISE ASSEMBLIES HAVING CRANK MEMBERS WITH LIMITED ROTATION

CROSS-REFERENCE TO RELATED APPLICATION

The present application is a continuation-in-part of U.S. patent application Ser. No. 14/047,448, filed Oct. 7, 2013, which is incorporated herein by reference in entirety. The present application is also a continuation-in-part of U.S. patent application Ser. No. 13/783,610, filed Mar. 4, 2013, which is incorporated herein by reference in entirety.

FIELD

The present disclosure relates to exercise assemblies.

BACKGROUND

U.S. Pat. No. 6,084,325, which is incorporated herein by reference in entirety discloses a resistance device with a combination of power-generating and eddy-current magnetic resistance having an outer fly wheel fastened on a central axle of a frame and fitted with a permanent magnet on the inner circular edge to form a rotor type, and the fly wheel is connected with a stator core fastened on the frame; more, one end of the central axle is stretching out of the frame and fitted with a belt wheel; the front end of the frame is fitted with a resistance device core adjacent to the outer edge of the fly wheel to supply a planned eddy current magnetic resistance to the fly wheel; in accordance with such design, the device generates power by means of the exercise force of users to drive the fly wheel to rotate, after passing through a DC power supply, it provides display & controlling gage with power source so that the power-generating and the eddy current magnetic resistance are integrated to reach the effect of reducing the volume and the producing cost.

U.S. Pat. No. 7,479,093, which is incorporated herein by reference in entirety discloses exercise apparatus having a pair of handles pivotally mounted on a frame and guiding respective user arm motions along swing paths obliquely approaching the sagittal plane of the user.

U.S. Pat. No. 7,625,317, which is incorporated herein by reference in entirety discloses exercise apparatus with a coupled mechanism providing coupled natural biomechanical three dimensional human motion.

U.S. Pat. No. 7,717,833, which is incorporated herein by reference in entirety discloses adjustable exercise machines, apparatuses, and systems. The disclosed machines, apparatuses, and systems typically include an adjustable, reversible mechanism that utilizes pivoting arms and a floating pulley. The disclosed machines, apparatuses, and systems typically are configured for performing pushing and pulling exercises and may provide for converging and diverging motion.

U.S. Pat. No. 7,918,766, which is incorporated herein by reference in entirety discloses an exercise apparatus for providing elliptical foot motion that utilizes a pair of rocking links suspended from an upper portion of the apparatus frame permitting at least limited arcuate motion of the lower portions of the links. Foot pedal assemblies are connected to rotating shafts or members located on the lower portion of the links such that the foot pedals will describe a generally elliptical path in response to user foot motion on the pedals.

U.S. Pat. No. 7,931,566, which is incorporated herein by reference in entirety discloses exercise apparatus, which may be an elliptical cross trainer, having a rotating inertial flywheel driven by user-engaged linkage exercising a user. A user-actuated resistance device engages and stops rotation of the flywheel upon actuation by the user.

U.S. Pat. No. 8,272,997, which is incorporated herein by reference in entirety, discloses a dynamic link mechanism in an elliptical step exercise apparatus that can be used to vary the stride length of the machine. A control system can also be used to vary stride length as a function of various exercise and operating parameters such as speed and direction as well as varying stride length as a part of a preprogrammed exercise routine such as a hill or interval training program. In addition the control system can use measurements of stride length to optimize operation of the apparatus.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain examples, exercise assemblies comprise a frame; a pair of elongated foot pedal members, each foot pedal member having a front portion and a rear portion; a pair of elongated coupler arms, each coupler arm having a lower portion and having an upper portion that is pivotally connected to the frame; a pair of crank members, each crank member having a first portion that is pivotally connected to the front portion of one of the pair of foot pedal members and having a second portion that is pivotally connected to the lower portion of one of the pair of coupler arms, such that each crank member is rotatable in a circular path; and a pair of elongated rocker arms, each rocker arm having a lower portion that is pivotally connected to one of the pair of foot pedal members in between the foot pad and the crank member and having an upper portion that is pivotally connected to the frame. The pair of foot pedal members are each movable along user-defined paths of different dimensions. The exercise assembly also comprises a front cross-shaft, wherein the pair of crank members are operatively connected to the front cross-shaft such that movement of each of the pair of crank members along the circular path causes rotation of the front cross-shaft. The pair of crank members are freely movable along the circular path in a first direction and restrained from rotation along the circular path in a second, opposite direction.

In certain examples, the exercise assembly comprises an arm that is connected to the front cross-shaft so that the front cross-shaft freely rotates in the first direction with respect to the arm, and so that the arm rotates along with the front cross-shaft in the second direction. A one-way clutch can be provided that connects the arm to the front cross-shaft. The arm can be rotatably fixed to the one-way clutch. A spring and the frame can prevent rotation of the arm in the second direction, wherein the spring is sandwiched between the frame and the arm when the arm rotates in the second direction.

BRIEF DESCRIPTION OF THE DRAWINGS

Examples of exercise assemblies are described with reference to the following drawing figures. The same numbers are used throughout the drawing figures to reference like features and components.

DETAILED DESCRIPTION OF THE DRAWINGS

In the present description, certain terms have been used for brevity, clearness, and understanding. No unnecessary limitations are to be inferred therefrom beyond the requirement of the prior art because such terms are used for descriptive purposes only and are intended to be broadly construed. The different assemblies described herein may be used alone or in combination with other apparatuses. Various equivalents, alternatives, and modifications are possible within the scope of the appended claims.

Figure 1:
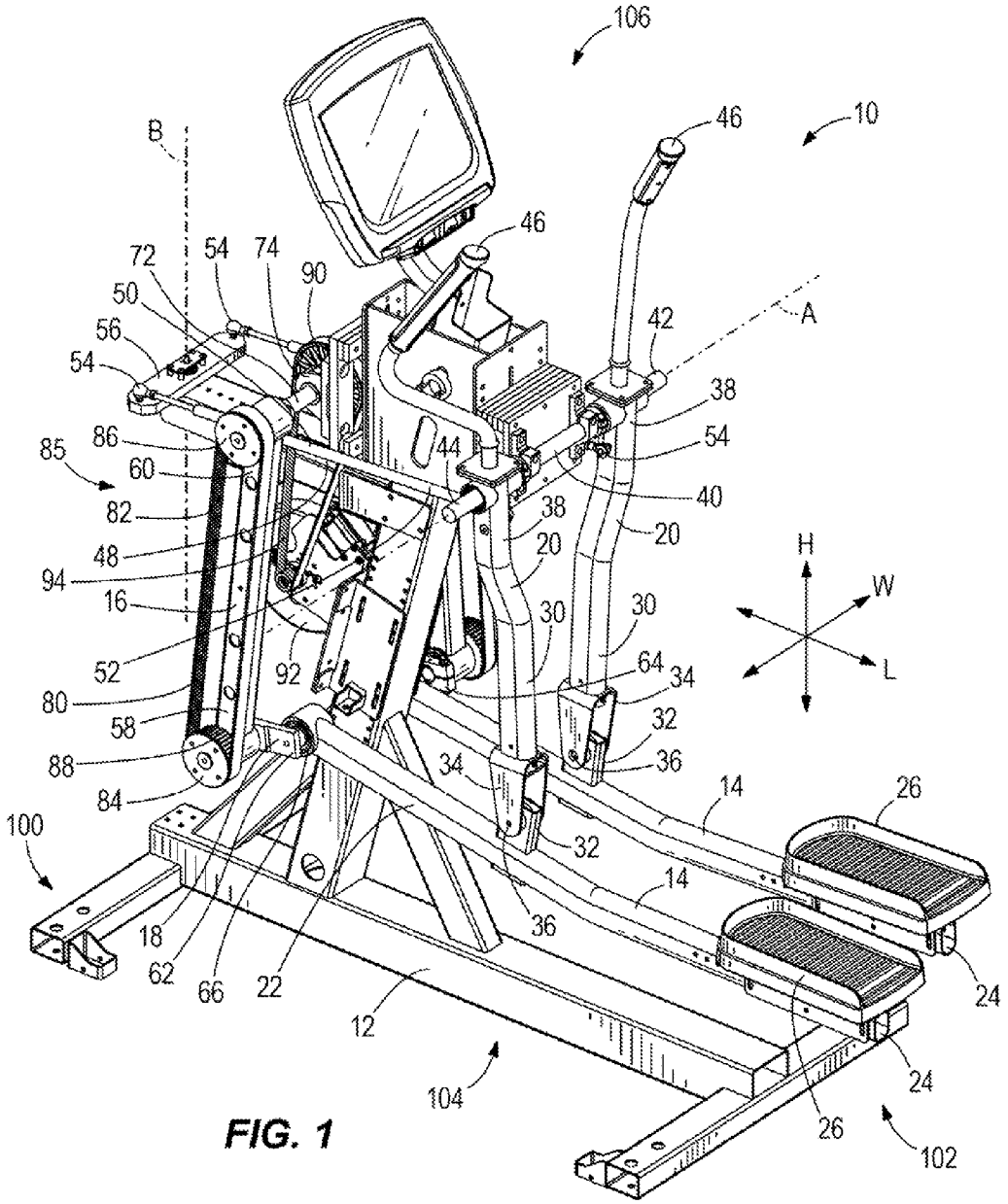
FIG. 1 is a perspective view of an exercise assembly.
Figure 2:
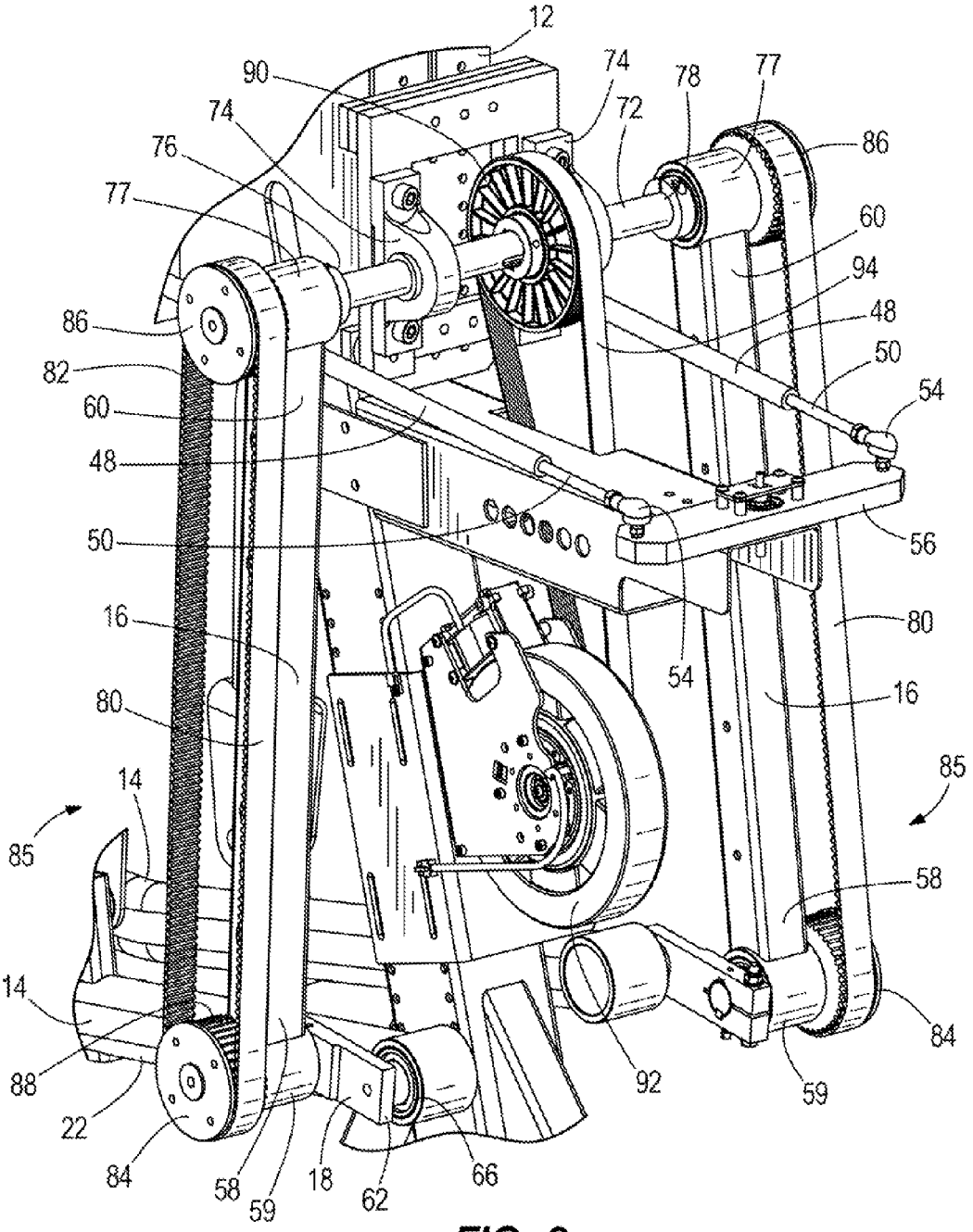
FIG. 2 is a closer view of a front portion of the exercise assembly.
Figure 3:
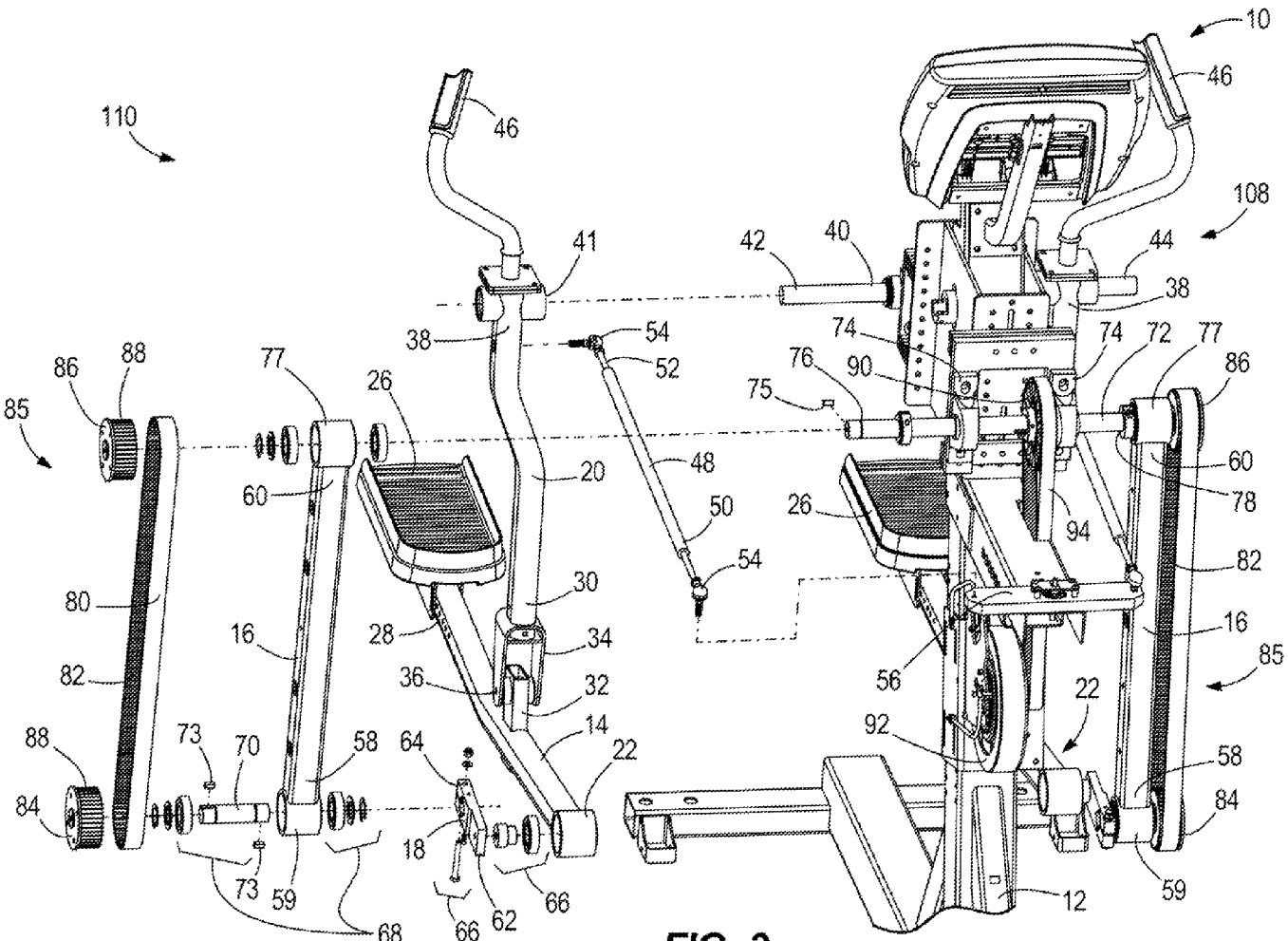
FIG. 3 is an exploded view of one side of the exercise assembly.

FIGS. 1-3 depict an exercise assembly 10 having a frame 12, a pair of elongated foot pedal members 14, a pair of elongated coupler arms 16, a pair of crank members 18 and a pair of elongated rocker arms 20. Each foot pedal member 14 has a front portion 22 and a rear portion 24. A pair of foot pads 26 is provided for supporting a user's feet. Each foot pad 26 is disposed on the rear portion 24 of one of the pair of foot pedal members 14. Each rocker arm 20 has a lower portion 30 that is pivotally connected to one of the pair of foot pedal members 14 at a location that is between the foot pad 26 and the crank member 18. Any suitable type of pivotal connection can be employed. In this example, an extension member 32 extends vertically upwardly from the foot pedal member 14 and pivotally connects a lower portion 30 of a rocker arm 20 to the foot pedal member 14. A U-shaped bracket 34 and a connecting pin 36 facilitate the connection such that the rocker arms 20 are pivotal with respect to the foot pedal members 14. Each extension member 32 extends upwardly from one of the respective pair of foot pedal members 14 and the U-shaped bracket 34 extends downwardly from the lower portion 30 of the respective rocker arms 20.

Each rocker arm 20 has an upper portion 38 that is directly or indirectly pivotally connected to the frame 12. The manner of connection to the frame 12 can vary. In this example, a rear cross-shaft 40 is secured to the frame 12 and has opposite ends 42, 44 on which the upper portions 38 of the rocker arms 20 are pivotally supported. In this example, the ends 42, 44 extend through respective bearings 41 in the rocker arms 20 to enable the freely rotatable, pivotal connection therewith. Thus, the pair of rocker arms 20 pivot about a common axis A, which extends through the rear cross-shaft 40.

A pair of handles 46 are disposed on the pair of rocker arms 20 and extend upwardly above the cross-shaft 40 such that movement of the handle 46 in a pivoting, rotational motion with respect to the axis A of the rear cross-shaft 40 causes similar, following pivoting, rotational motion of the lower portion 30 of the rocker arm 20.

Elongated link members 48 each have a front portion 50 and a rear portion 52. The rear portion 52 is pivotally connected to one of the pair of rocker arms 20. In this example, the connection between the rear portion 52 of the link member 48 and the rocker arm 20 is provided by a pivotal joint 54. A cross-link member 56 is pivotally connected to the frame 12 at a pivot axis B that extends between the link members 48. The front portions 50 of the link members 48 are pivotally connected to opposite ends of the cross-link member 56. In this example, the connection is made by pivotal joints 54. In this manner, the noted pivoting movement of each rocker arm 20 with respect to the axis A is translated to the other rocker arm 20 via the link members 48 acting on the opposite ends of the cross-link member 56, which in turn pivots about the noted pivot axis B.

The pair of coupler arms 16 each has a lower portion 58 and an upper portion 60. Each crank member 18 has a first end or portion 62 that is pivotally connected to the front portion 22 of one of the pair of foot pedal members 14 and also has a second end or portion 64 that is pivotally connected to the lower portion 58 of one of the pair of coupler arms 16. Connection of the first portion 62 of each crank member 18 is facilitated by a bearing and pin assembly 66 configured such that the crank member 18 freely rotates with respect to the foot pedal member 14. Connection of the second portion 64 of the crank member 18 to the lower portion 58 of the coupler arm 16 is facilitated by a bearing and through shaft assembly 68, wherein a through shaft 70 extends through a hub 59 in the lower portion 58 of the coupler arm 16 so that the coupler arm 16 can freely pivot with respect to the through shaft 70.

A front cross-shaft 72 is connected to the frame 12 by a pair of bearings 74. The front cross-shaft 72 has opposing ends 76, 78 on which the upper portions 60 of the coupler arms 16 freely pivotally rotate. In this example, the front cross-shaft 72 effectively pivotally connects the upper portions 60 of the pair of coupler arms 16 to the frame 12 through bearings in hub 77 in the upper portions 60.

A pair of timing belts 80 having internal grooves 82 is connected at one end to the second portion 64 of the crank members 18 such that movement of the crank members 18 causes rotation of the respective timing belt 80. In this example, a pair of lower timing pulleys 84 is rotatably, fixedly connected to the crank members 18 via the bearing and through shaft assembly 68 such that rotation of the crank members 18 causes rotation of the lower timing pulleys 84. In this example, the fixed rotational connection is provided by locking keys 73. The timing belts 80 are fixedly, rotatably connected at their upper end to the opposing ends 76, 78 of the front cross-shaft 72 such that rotation of the timing belts 80 causes rotation of the front cross-shaft 72. Connection between the timing belts 80 and the front cross-shaft 72 is facilitated by a pair of upper timing pulleys 86. Upper timing pulleys 86 are connected to one end of the front cross-shaft 72 and transfers rotational movement of the respective timing belt 80 to the front cross-shaft 72. Each of the upper and lower timing pulleys 84, 86 have external ridges 88 that engage with the internal grooves 82 on the timing belts 80 to thereby transfer the noted rotation between the timing pulleys 84, 86 and timing belts 80. In this example, the fixed rotational connection between the timing pulleys 86 and front cross-shaft 72 is provided by locking keys 75.

A pulley 90 is rotationally fixed with and connected to a center portion of the front cross-shaft 72 such that rotation of the front cross-shaft 72 causes rotation of the pulley 90. A resistance device 92 is connected to the frame 12. The resistance device 92 can include one or more of any conventional resistance device, such as the resistance device having a combination of power generating and eddy current magnetic resistance disclosed in the incorporated U.S. Pat. No. 6,084,325. A pulley belt 94 connects the resistance device 92 to the pulley 90 such that rotation of the pulley 90 (which is caused by rotation of the front cross-shaft 72) is translated to the resistance device 92 by the pulley belt 94. In this example, the resistance device 92 generates power based upon rotation of the pulley 90.

It will thus be seen from drawing FIGS. 1-3 that the present disclosure provides an exercise assembly 10 that extends from a front end 100 to a back end 102 in a length direction L, from a lower end 104 to an upper end 106 in a height direction H that is perpendicular to the length direction L, and from a first side 108 to a second side 110 in a width direction W that is perpendicular to the height direction H and perpendicular to the length direction L. In these examples, the assembly 10 has the noted pair of elongated foot pedal members 14, each of which extend in the length direction L between the front portion 22 and rear portion 24. The pair of foot pads 26 is disposed on the rear portion 24 of one of the foot pedal members 14. The pair of elongated coupler arms 16 extends in the height direction H between a lower portion 58 and an upper portion 60. The pair of crank members 18 extend between the first portion 62 that is pivotally connected to the front portion 22 of one of the pair of foot pedal members 14 and the second portion 64 that is pivotally connected to the lower portion 58 of one of the coupler arms 16, such that each crank member 18 is rotatable in the circular path C (see FIG. 4) with respect to the coupler arm 16 and foot pedal member 14 when viewed from the first and second sides 108, 110. The pair of elongated rocker arms 20 each has the lower portion 30 that is pivotally connected to one of the pair of foot pedal members 14 in between the foot pad 26 and the crank member 18. As described further herein below, the pair of foot pedal members 14 are each movable along generally elliptical, vertical and horizontal paths of differing dimensions when viewed from the first and second sides 108, 110. The pair of elongated link members 48 extends in the length direction L between a front portion 50 and a rear portion 52 that is pivotally connected to one of the pair of rocker arms 20. The cross-link member 56 extends in the width direction W between opposite ends. The front portions 50 of the link members 48 are pivotally connected to one of the opposite ends of the cross-link member 56. The cross-link member 56 pivots about the axis B disposed between the pair of link members 48 in the width direction W.

Figure 4:
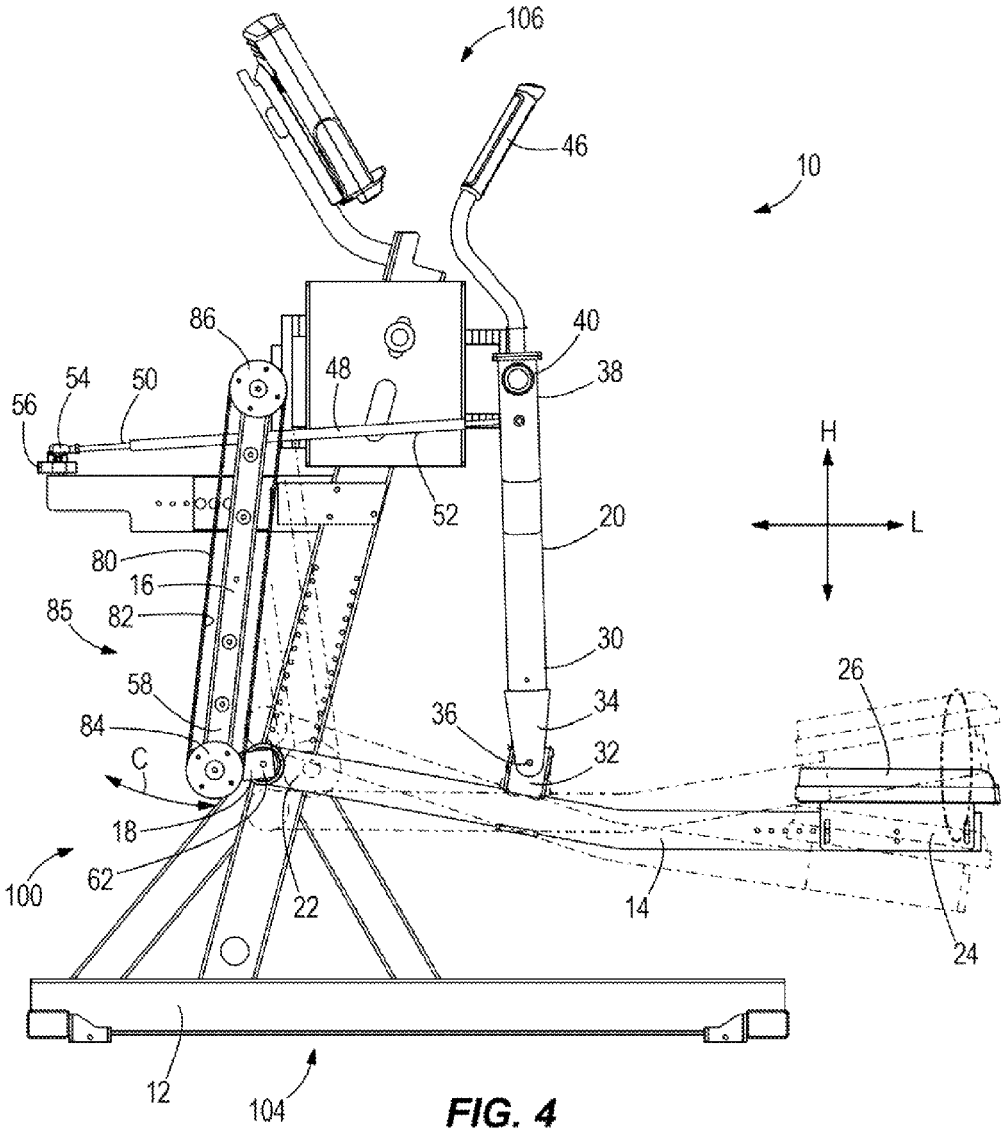
FIG. 4 is a side view of the assembly showing vertical stepping motion.
Figure 5:
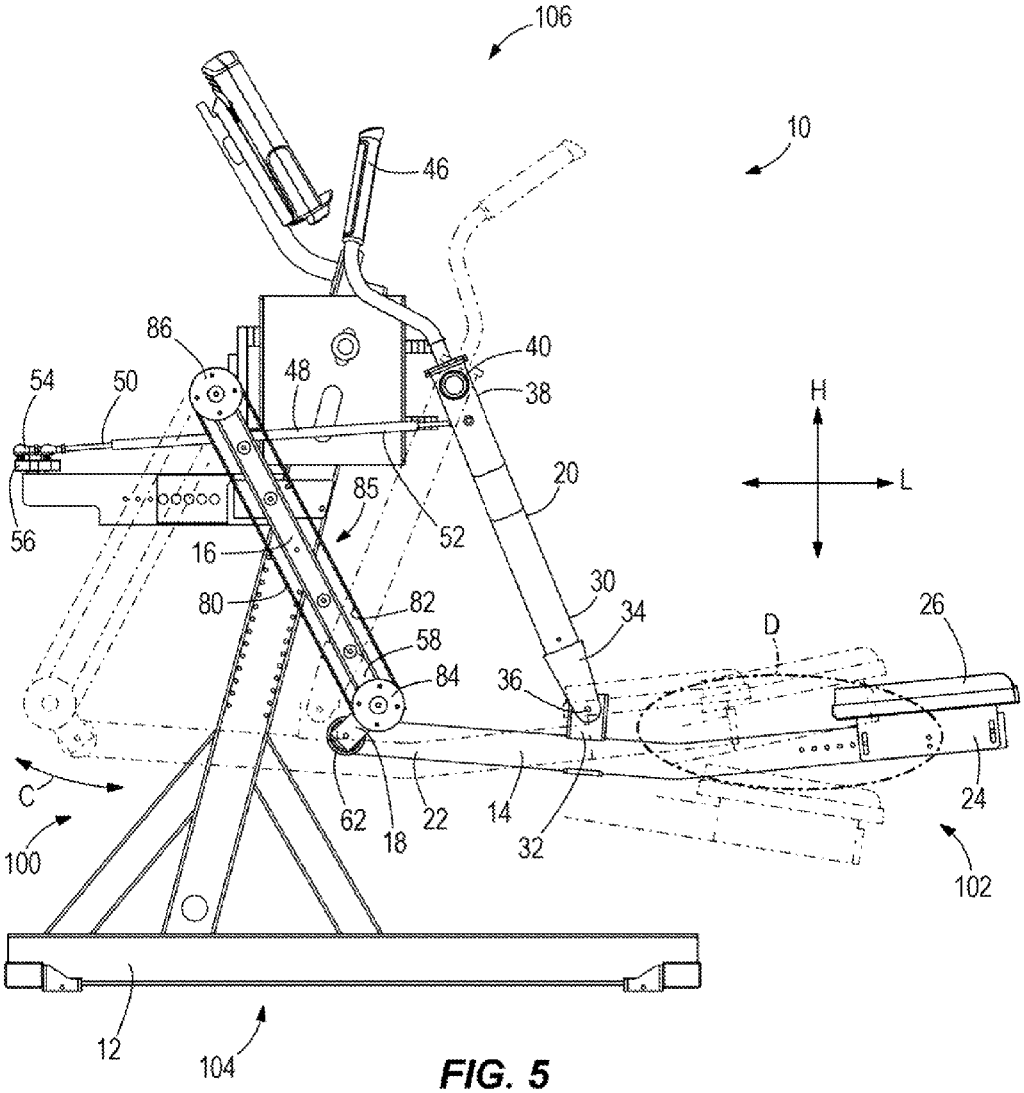
FIG. 5 is a side view of the assembly showing elliptical motion.

FIGS. 4 and 5 depict the exercise assembly 10 during certain exercise motions. In FIG. 4, the operator applies a generally vertical, up and down stepping motion onto the foot pads 26, which causes the foot pedal members 14 to vertically reciprocate as shown in phantom line in FIG. 4. Simultaneously, the user grasps the handles 46. The handles 46 can be maintained generally stationary with respect to the length direction L during vertical reciprocation of the foot pedal members 14. During the movements described above, the crank members 18 pivot in a generally circular path with respect to the foot pedal members 14 and coupler arms 16, as shown by the arrow C. The movement shown at line C can occur in both clockwise and counter-clockwise directions to exercise different muscle groups. During workout activities, the amount of operator hand motion on the handles 46 will help determine the shape of the path of the foot pedal members 14. The stride length of the path can be dynamically changed from short too long or from long to short.

FIG. 5 shows the assembly 10 during an extended stride exercise wherein the user applies movement as shown at line D to the foot pads 26 on the foot pedal members 14. The movement shown at line D can occur in both clockwise and counter-clockwise directions to exercise different muscle groups. The user also applies opposing back and forth motions in the length direction L onto the handles 46. These motions cause the rocker arms 20 and coupler arms 16 to pivot about the respective cross-shafts 40, 72, as shown in phantom line in FIG. 5. Again, the crank members 18 rotate in a generally circular pathway as shown at arrow C.

The noted circular movement of the crank members 18 is transferred to the lower timing pulleys 84, timing belt 80, upper timing pulleys 86, front cross-shaft 72, pulley belt 94, and ultimately to the resistance device 92 for braking function and power generating, per the description in the incorporated U.S. Pat. No. 6,084,325.

As those having ordinary skill in the an would understand, the exercise assembly 10 thus facilitates a movement of the foot pedal members 14 along elliptical, vertical and horizontal paths of differing dimensions when viewed from the first and second sides 108, 110.

Figure 6:
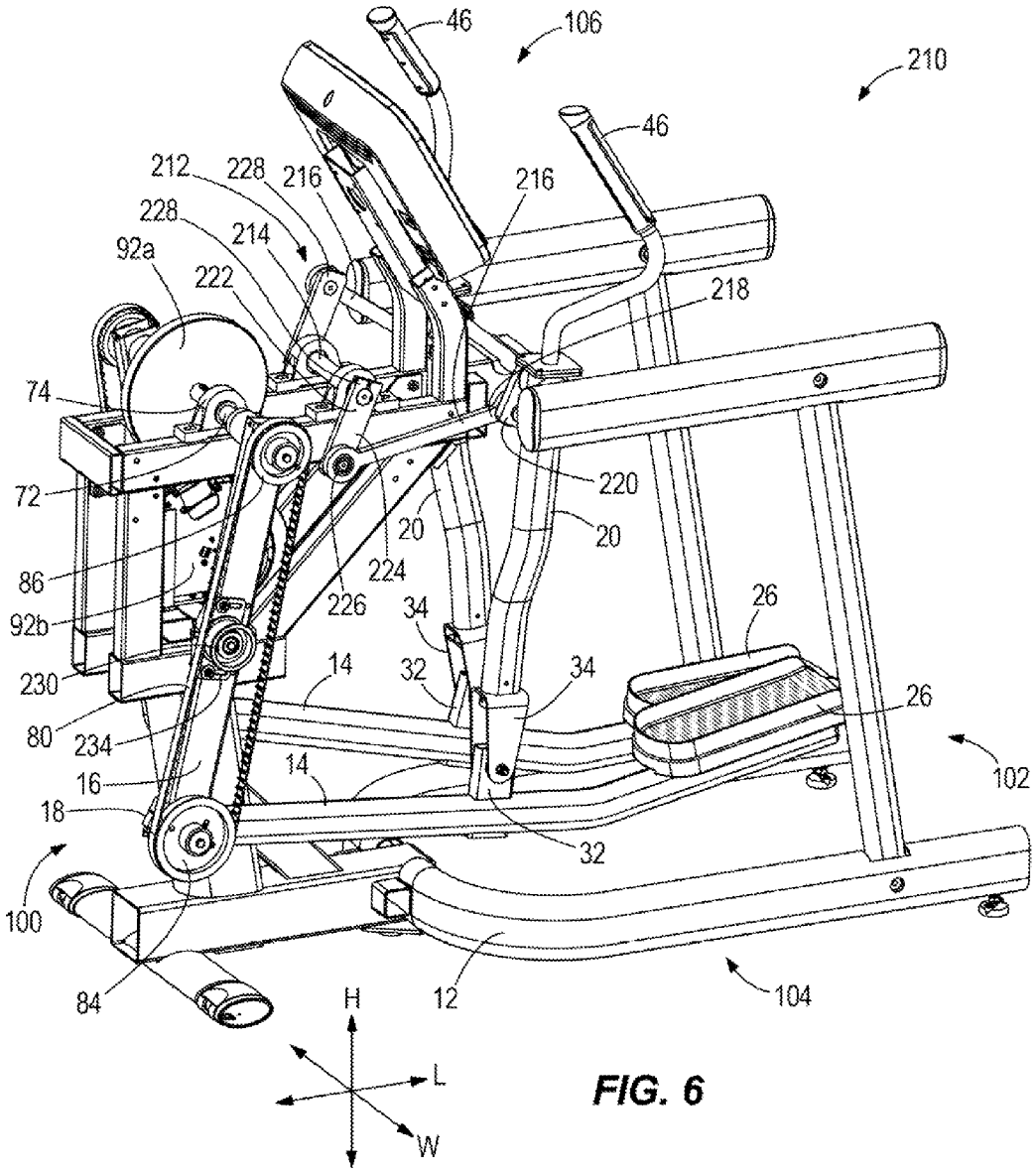
FIG. 6 is a perspective view of another embodiment of an exercise assembly.
Figure 7:
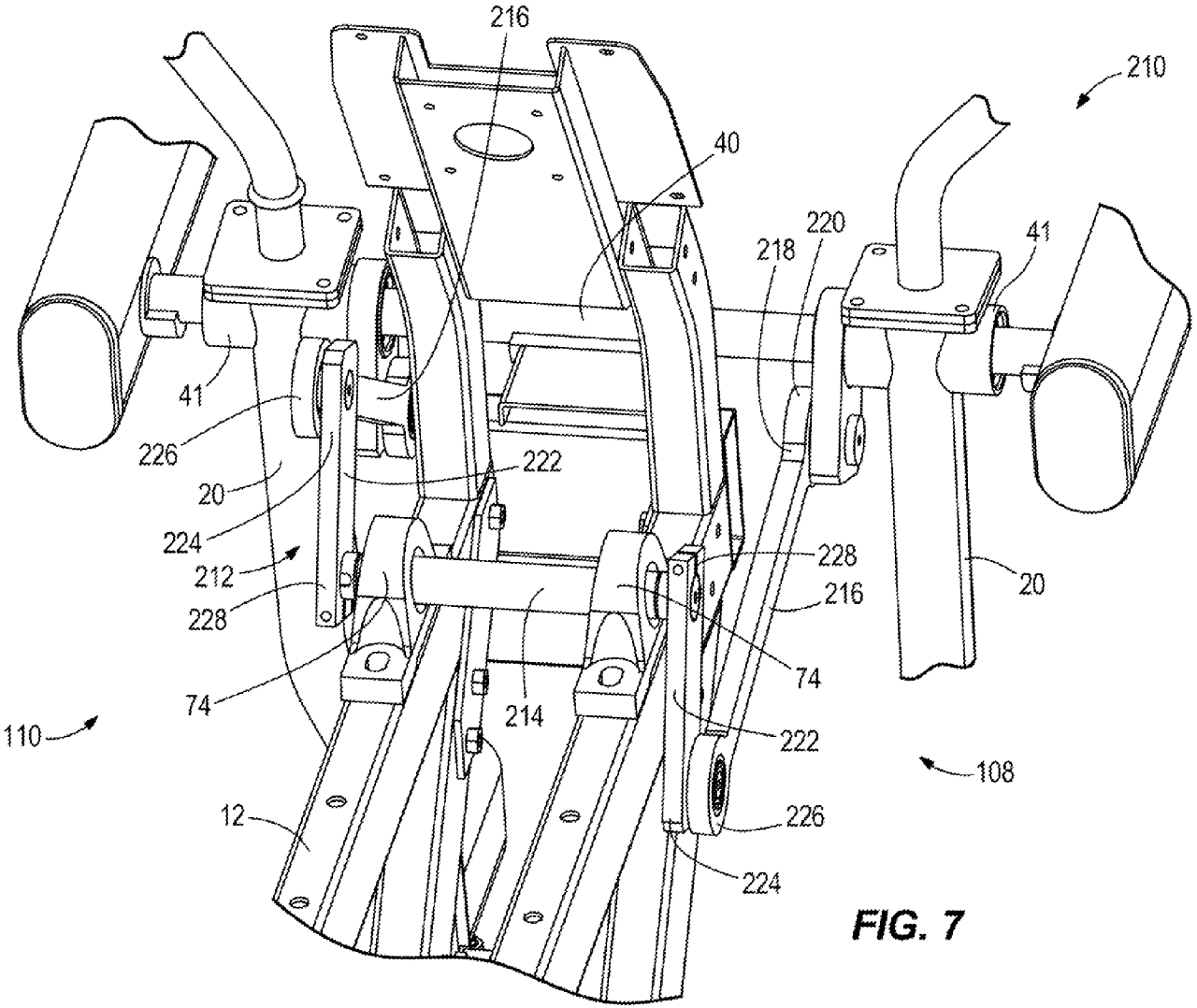
FIG. 7 is a closer view of a front portion of the exercise assembly shown in FIG. 6.
Figure 8:
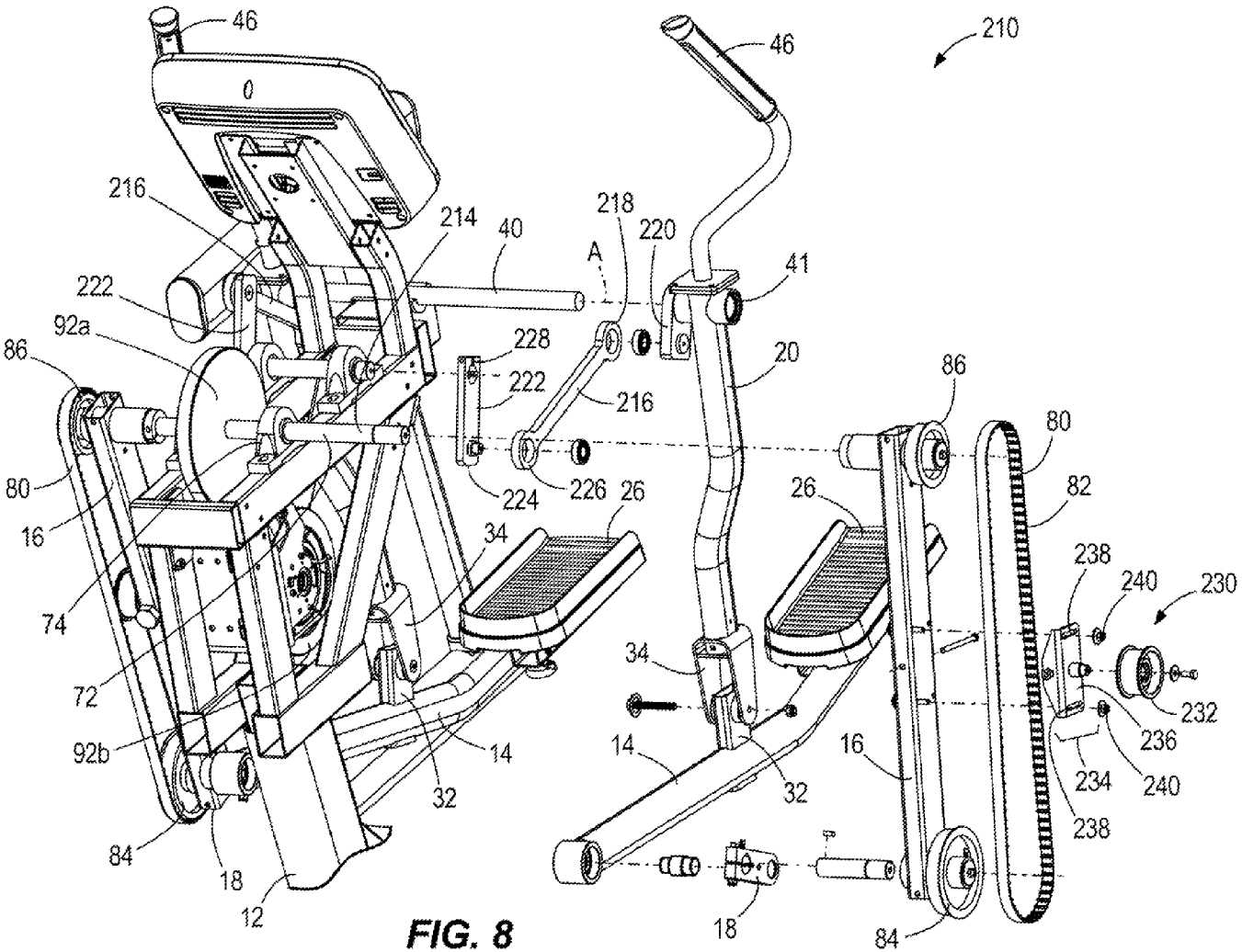
FIG. 8 is an exploded view of one side of the exercise assembly shown in FIG. 6.
Figure 9:
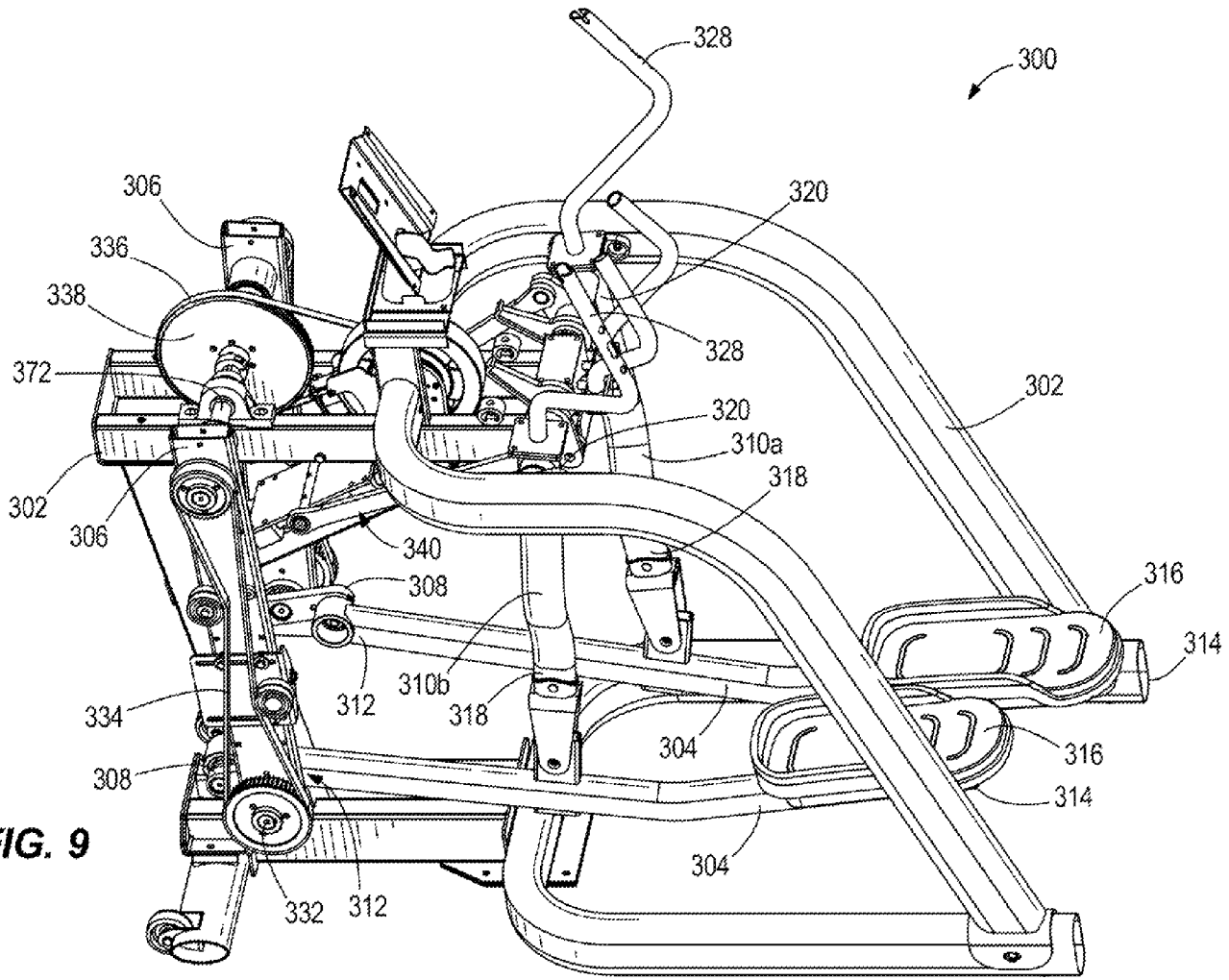
FIG. 9 is a perspective view of another example of an exercise assembly.
Figure 10:
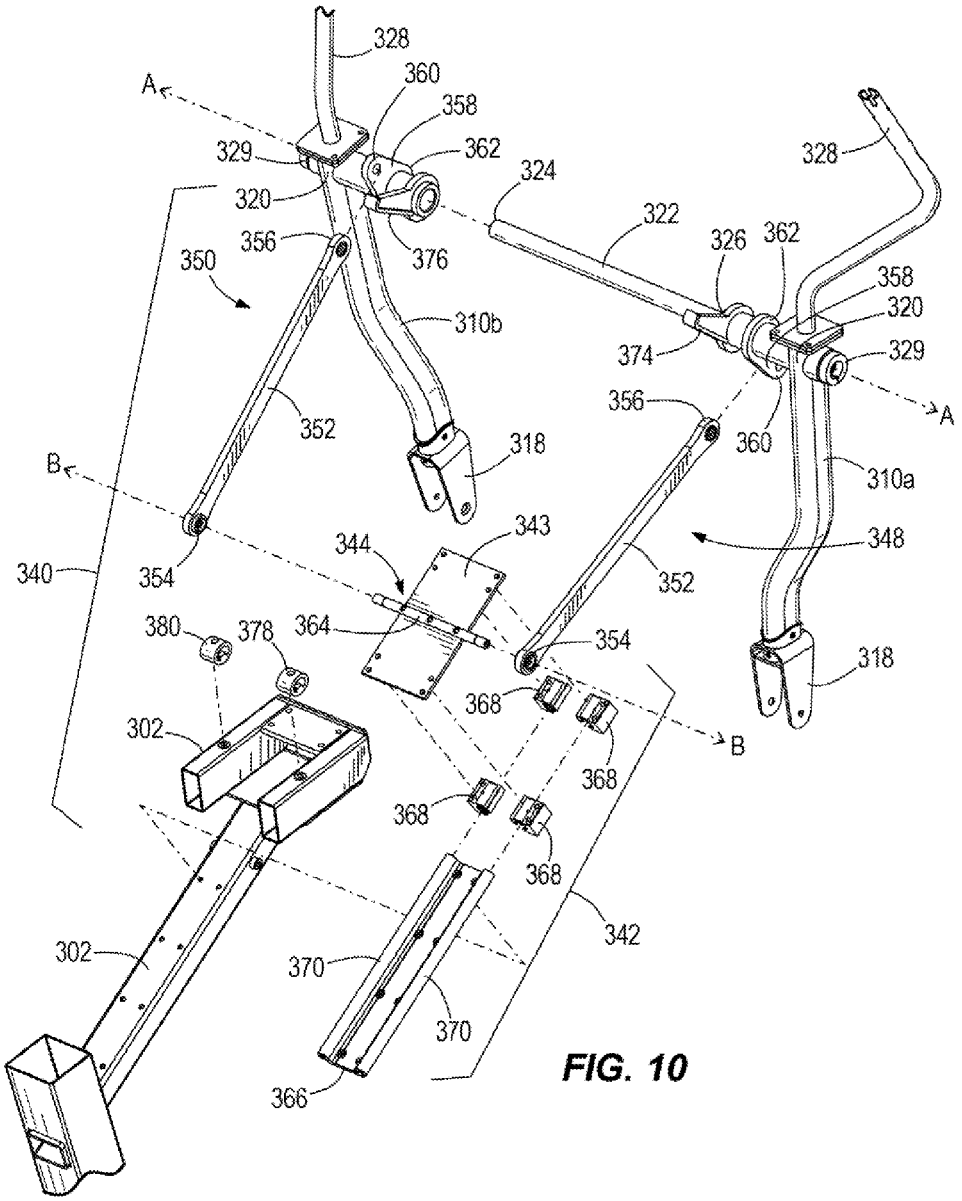
FIG. 10 is an exploded view of one portion of the exercise assembly shown in FIG. 9.

FIGS. 6-8 depict another embodiment of an exercise assembly 210. The exercise assembly 210 has many features in common with or functionally similar to the exercise assembly 10 shown in FIGS. 1-5. Many of the features that are the same or similar in structure and/or function are given like reference numbers. However, all of the reference numbers provided in FIGS. 1-5 are not necessarily provided in FIGS. 6-8 to avoid clutter and maintain clarity of this description.

The exercise assembly 210 differs from the exercise assembly 10 in that it does not include the elongated link members 48, pivotal joints 54, and cross-link member 56. Instead, the exercise assembly 210 includes a cross-linking mechanism 212 that pivotally connects the pair of rocker arms 20 together such that movement of one of the pair of rocker arms 20 causes counteracting, opposite movement in the other of the pair of rocker arms 20. The cross-linking mechanism 212 includes a "four-bar mechanism" having a cross-linking shaft 214. A pair of first elongated link members 216 each have a rear portion 218 that is pivotally coupled to one of the pair of rocker arms 20. More specifically, the rear portions 218 are pivotally coupled to extension members 220 that are fixedly coupled to one of the pair of rocker arms 20. In this manner, the pair of first elongated link members pivot with respect to the extension members 220, and thus with respect to the pair of rocker arms 20.

A pair of second elongated link members 222 each have a first portion 224 that is pivotally coupled to a front portion 226 of one of the pair of first elongated link members 216 and a second portion 228 that is fixedly coupled to the cross-linking shaft 214, such that rotation of one of the pair of second elongated link members 222 causes rotation of the cross-linking shaft 214 about its own axis, and rotation of the other of the pair of second elongated link members 222.

In this example, the respective pairs of first and second elongated link members 216, 222 are oppositely oriented with respect to each other and the cross-linking shaft 214. That is, as shown in FIG. 7, the first and second elongated link members 216, 222 on the first side 108 are vertically oriented downwardly, whereas the first and second elongated link members 216, 222 on the opposite, second side 110 are vertically oriented upwardly. The particular orientation of the respective link members 216, 222 can vary from that which is shown.

Movement of one of the pair of rocker arms 20 causes pivoting movement of one of the pair of first elongated link members 216 via the fixed extension member 220. Pivoting movement of the first elongated link member 216 causes pivoting movement of a corresponding one of the pair of second elongated link members 222. Pivoting movement of the second elongated link member 222 causes rotation of the cross-linking shaft 214 about its own axis, which is translated to the other of the pair of second elongated link members 222, which in turn causes pivoting movement of the other of the first elongated link member 216. Movement of the other of the first elongated link member 216 is translated to the other of the pair of rocker arms 20 via the extension member 220. Thus, the cross-linking mechanism 212 operably connects the pair of rocker arms 20 together.

The exercise assembly 210 shown in FIGS. 6-8 also differs from the exercise assembly 10 in that it includes a pair of belt tightening mechanisms 230 for adjusting tension in the pair of timing belts 80. Each pair of belt tightening mechanisms includes an idler wheel 232 that is coupled to one of the pair of coupler arms 16 by a joint 234. The joint 234 includes a plate 236 having at least one slot 238 that receives a fixing screw 240. The fixing screw can be fixed to the plate at different slot locations along the length of the slot 238 such that the idler wheel 232 is fixed at different locations with respect to the coupler arm 16. Adjusting the position of the idler wheel 232 transversely outwardly with respect to the elongated coupler arm 16 forces the outer radius of the idler wheel 232 against the internal grooves 82 on the timing belt 80, thus tensioning the timing belt 80. Opposite movement of the idler wheel 232 via the movable joint 234 releases tension on the timing belt 80.

The exercise assembly 210 shown in FIGS. 6-8 also differs from the exercise assembly 10 in that it includes a pair of resistance devices 92*a*, 92*b*. As discussed above, regarding the exercise assembly 10, the number and configuration of the resistance devices can vary.

FIGS. 9-13 depict another example of an exercise assembly 300 having a frame 302, a pair of elongated foot pedal members 304, a pair of elongated coupler arms 306, a pair of crank members 308 and a pair of elongated rocker arms 310*a*, 310*b*. Each foot pedal member 304 has a front portion 312 and a rear portion 314. A pair of foot pads 316 is provided for supporting a user's feet. Each foot pad 316 is disposed on the rear portion 314 of one of the pair of foot pedal members 304. Each rocker arm 310*a*, 310*b* has a lower portion 318 that is pivotally connected to one of the pair of foot pedal members 304 at a location that is between the foot pad 316 and the crank member 308. Any type of pivotal connection can be employed. The manner of connection of the rocker arms 310*a*, 310*b* to the foot pedal members 304 is similar to the embodiments described herein above and therefore is not here described, for brevity.

As in the previous embodiments, each rocker arm 310*a*, 310*b* has an upper portion 320 that is directly or indirectly pivotally connected to the frame 302. The manner of connection to the frame 302 can vary. In this example, a rear cross-shaft 322 (see FIG. 10) is secured to the frame 302 and has opposite ends 324, 326 on which the upper portions 320 of the rocker arms 310*a*, 310*b* are pivotally supported. In this example, the ends 324, 326 extend through respective bearings 329 in the rocker arms 310*a*, 310*b* to enable the freely rotatable, pivotal connection therewith. Thus, the pair of rocker arms 310*a*, 310*b* pivot about a common pivot axis A, which extends through the rear cross-shaft 322.

A pair of handles 328 is disposed on the pair of rocker arms 310*a*, 310*b* and extends upwardly above the cross-shaft 322 such that movement of the handles 328 in a pivoting, scissors-like motion with respect to the axis A causes similar, following pivoting, scissors-like motion of the lower portion 318 of the rocker arm 310*a*, 310*b*.

The coupler arms 306, crank members 308, front cross-shaft 372, and an associated bearing and through shaft assembly 332, a pair of timing belts 334, pulley 336 and resistance device 338 can be constructed to function in a similar manner to the embodiments described herein above regarding FIGS. 1-8 and therefore are not further here described, for brevity.

Instead of the elongated link members 48, and cross-link member 56 of the embodiment shown in FIGS. 1-5, and instead of the cross-linking mechanism 212 shown in the embodiment of FIGS. 6-8, the exercise assembly 300 includes a linear motion synchronizing mechanism 340 (see FIG. 10) that provides symmetric left-right synchronization of the rocker arms 310*a*, 310*b*. The linear motion synchronizing mechanism 340 can allow for a compact design and flexible mounting orientation in comparison to other linking arrangements.

The linear motion synchronizing mechanism 340 includes a slider 342 having a slider body 344 that slides along a linear axis L (see FIGS. 11-13) extending through and perpendicular to the pivot axis A. A linkage pivotally couples the first and second rocker arms 310*a*, 310*b* to the slider body 344. As will be discussed further herein below, pivoting the first and second rocker arms 310*a*, 310*b* with respect to each other causes the slider body 344 to slide in a first direction along the linear axis L. Opposite pivoting of the first and second rocker arms 310*a*, 310*b* with respect to each other causes the slider body 344 to slide in an opposite, second direction along the linear axis L. The slider 342 and the linkage together restrict pivoting motion of the first and second rocker arms 310*a*, 310*b* to opposite directions and at an equal angular velocity with respect to each other.

The linkage includes a first linkage portion 348 (see FIG. 10) for the first rocker arm 310*a* and an oppositely oriented second linkage portion 350 for the second rocker arm 310*b*. The first and second linkage portions 348, 350 are pivotally connected to the slider 342 at a second pivot axis B. The second pivot axis B extends parallel to the first pivot axis A. Each of the first and second linkage portions 348, 350 includes a linear extension arm 352 having first and second ends 354, 356 and a radial crank arm 358 having first and second ends 360, 362. The first end 354 of the extension arm 352 is pivotally coupled to the slider 342 at the second pivot axis B. The second end 356 of the extension arm 352 is pivotally coupled to the first end 360 of the crank arm 358. The second end 362 of the crank arm 358 is fixed to and rotates with one of the first and second rocker arms 310.

Figure 11:
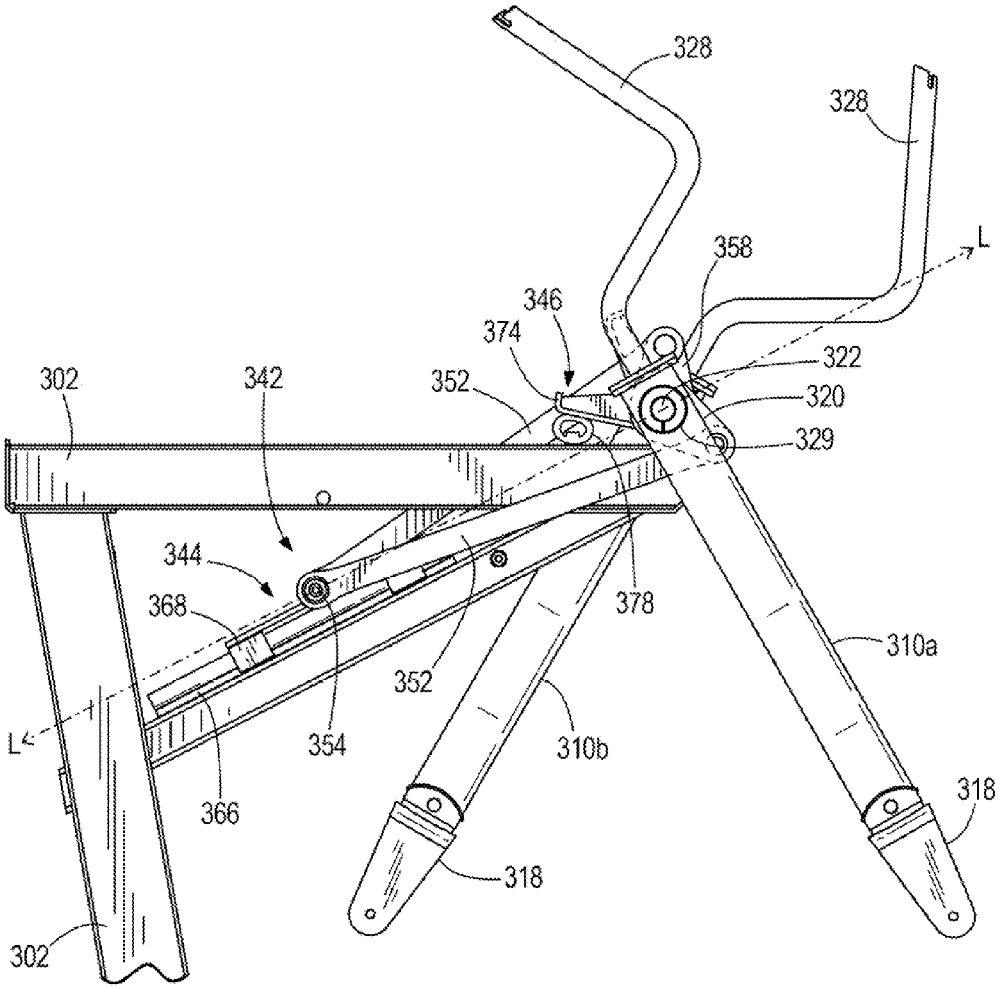
FIGS. 11-13 are side views of the portion of the exercise assembly, showing scissors-like motion of a pair of elongated rocker arms shown in FIG. 9.
Figure 12:
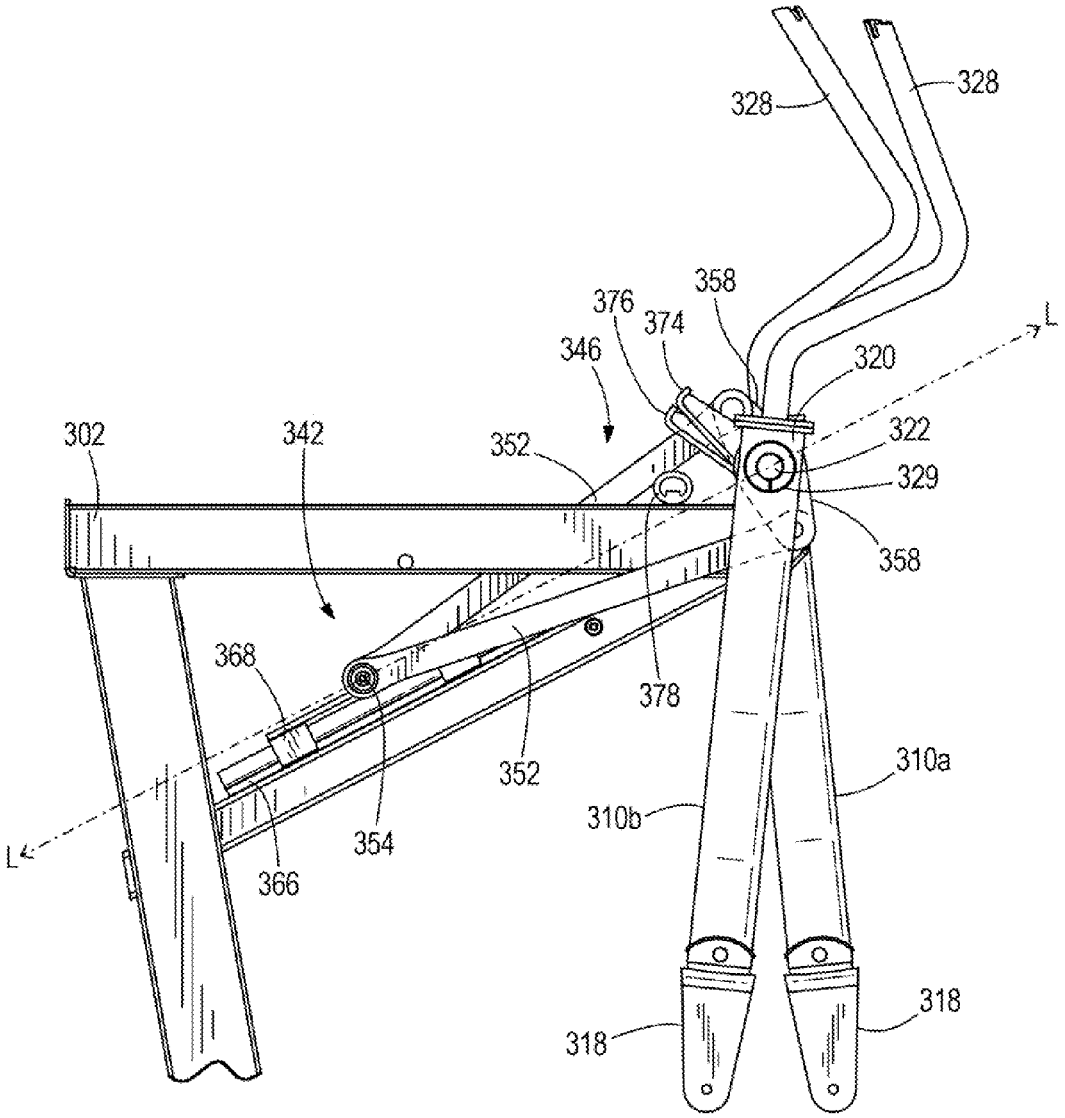
Figure 13:
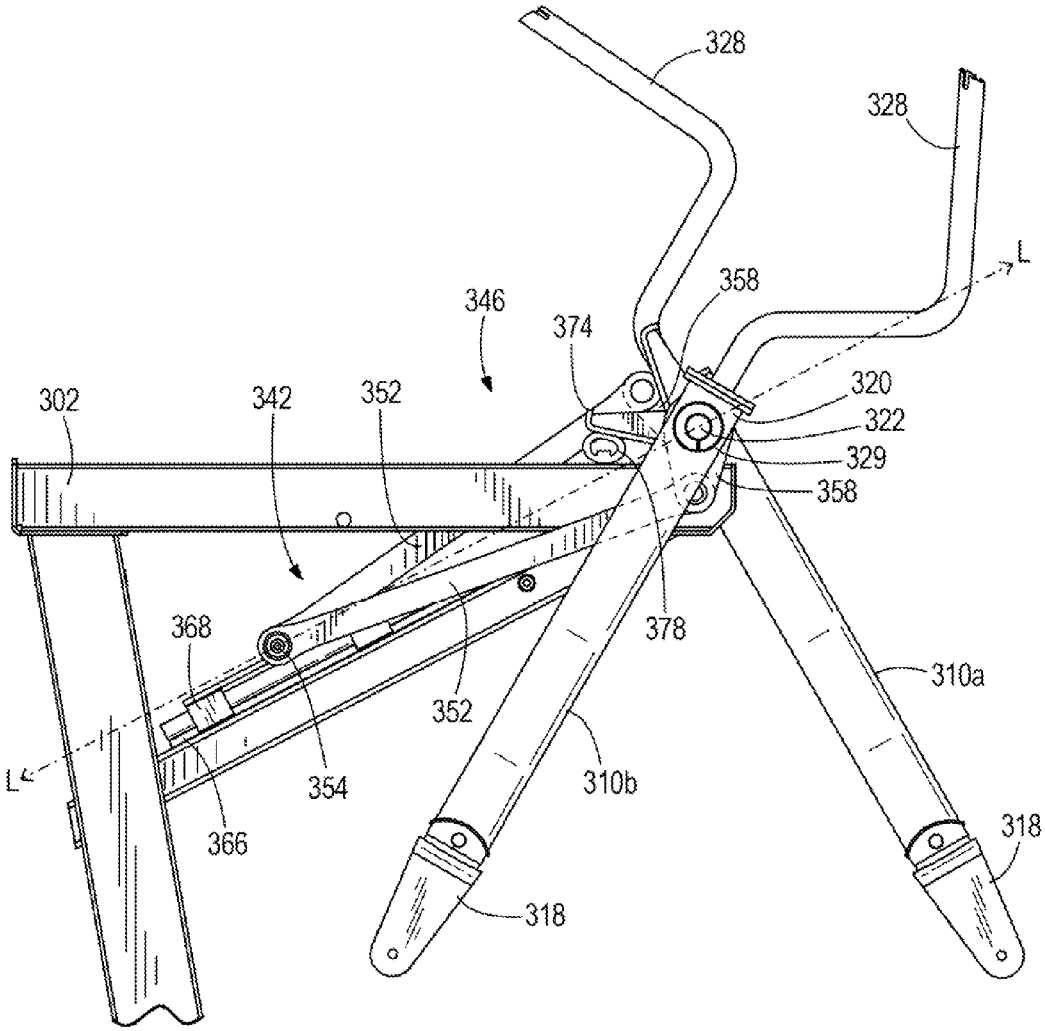
Figure 14:
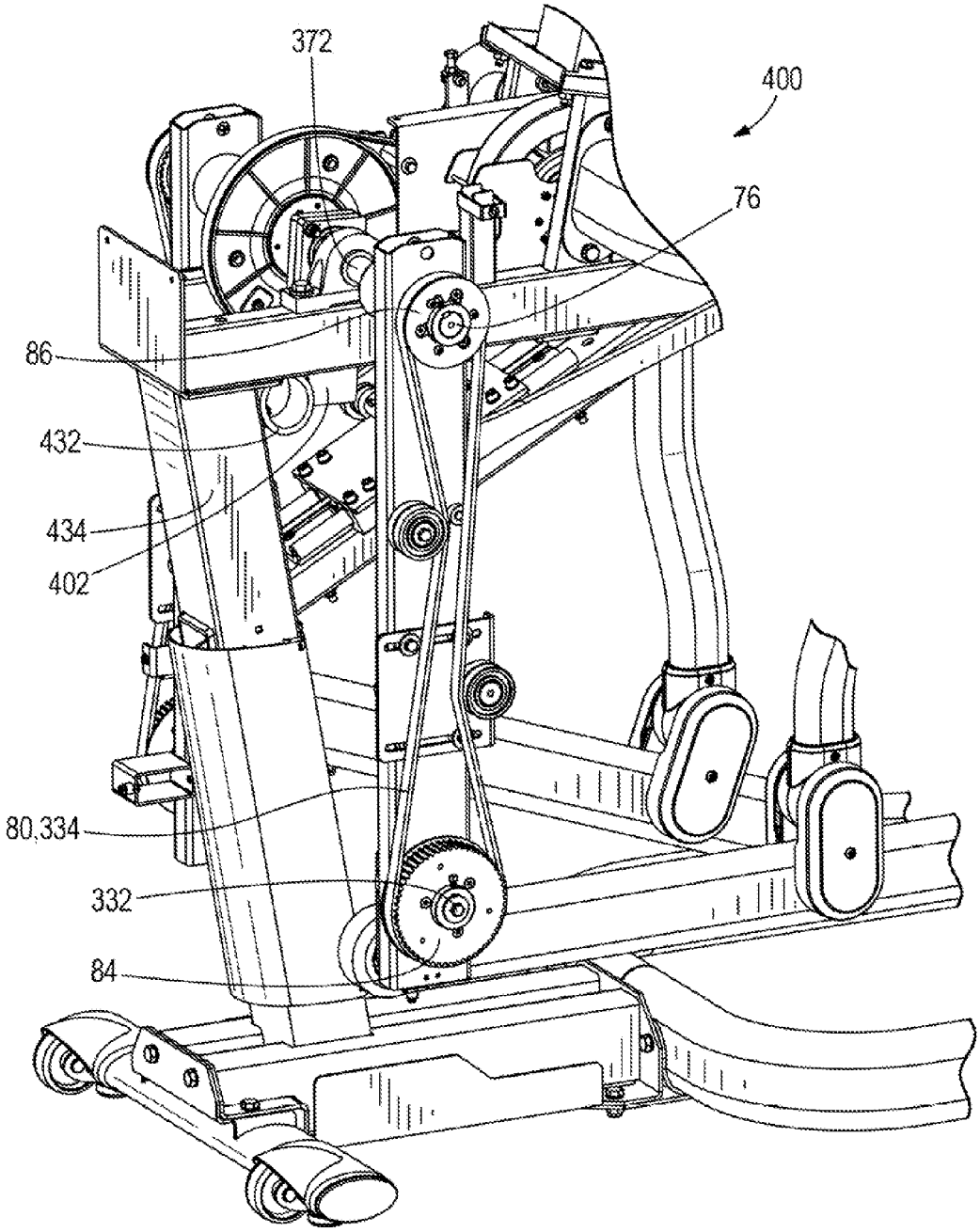
FIG. 14 is a perspective view of a front portion of another example of an exercise assembly.
Figure 15:
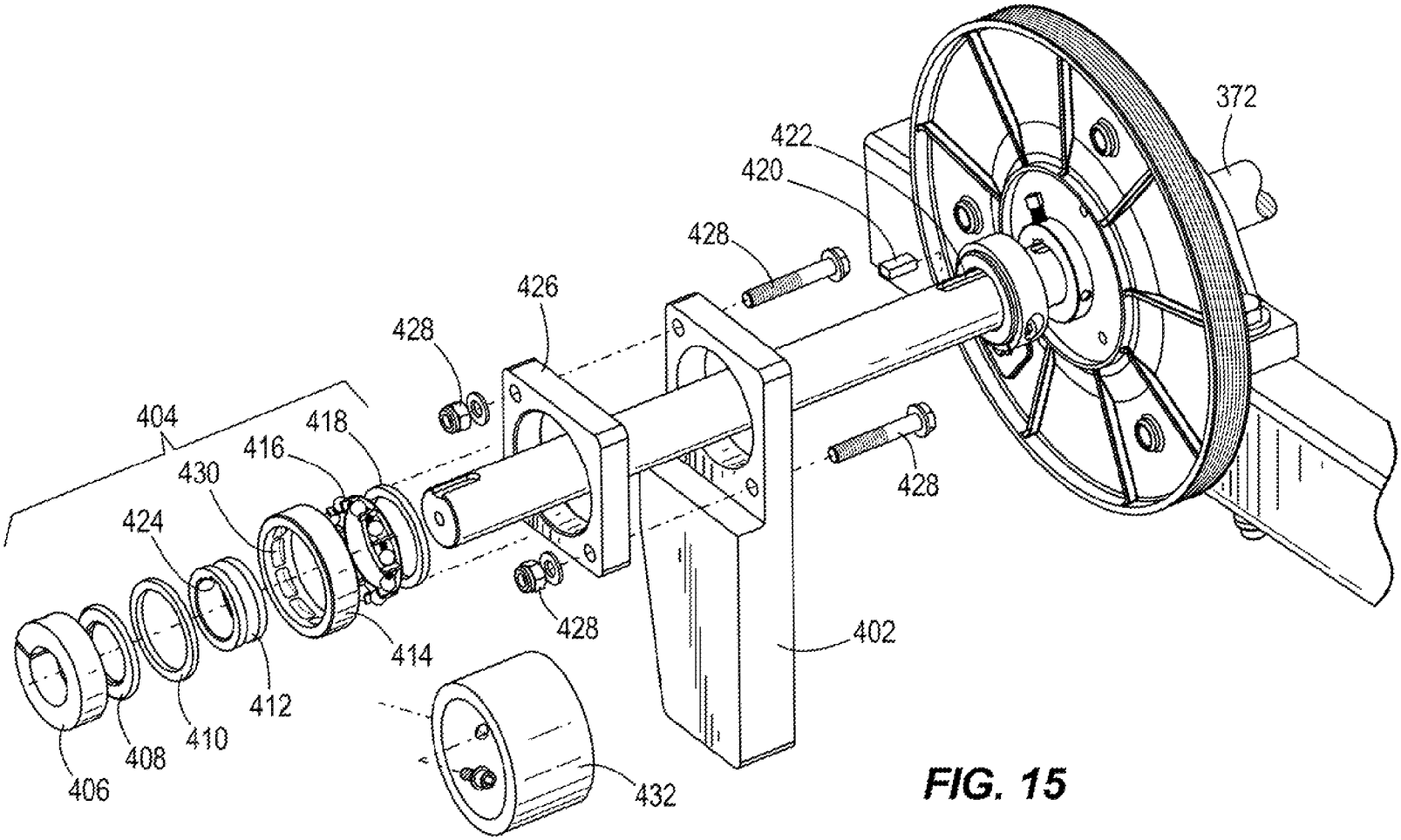
FIG. 15 is an exploded view of means for controlling movement of a pair of crank members on the exercise assembly.
Figure 16:
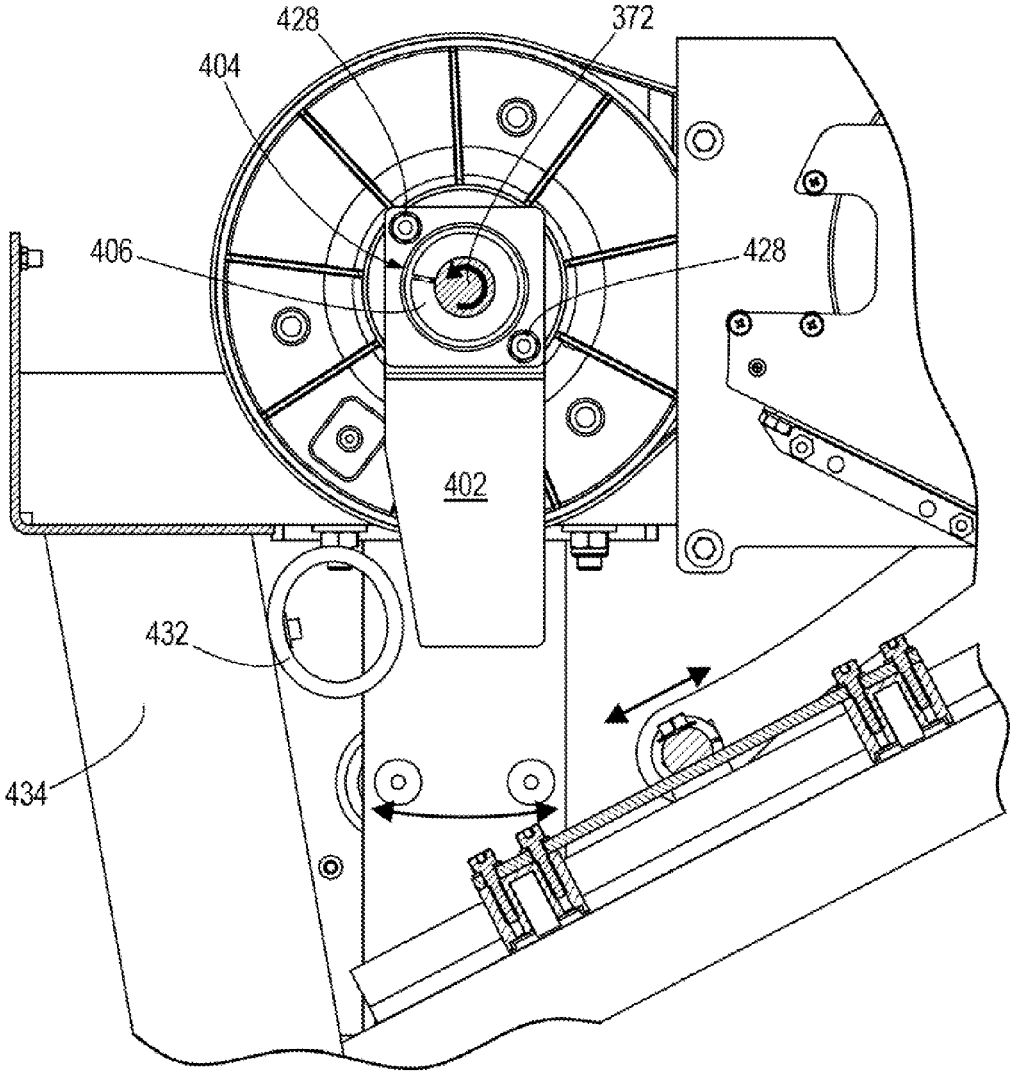
FIGS. 16 and 17 are side views of the front portion of the exercise assembly shown in FIG. 14.

The slider 342 includes a bed 343 and pivot shaft 364 that extends along the noted second pivot axis B between the first ends 354 of the extension arms 352. The slider 342 also includes a stationary base 366 and linear bearings 368 that slide along linear tracks 370 on the stationary base 366. The linear bearings 368 include two pairs of spaced apart linear bearings. A pair of spaced apart and parallel linear tracks 370 extends parallel to the linear axis L. The bed 343 and pairs of spaced apart linear bearings 368 together slide on the pair of linear tracks 370, as shown in FIGS. 11-13, when the first and second rocker arms 310*a*, 310*b* are pivoted with respect to each other in the noted scissors-like motion about the first pivot axis A.

The slider 342 also includes the pivot shaft 364 that extends along the second pivot axis B between the first ends 354 of the extension arms 352. The first end 360 of the crank arm 358 of the first linkage 346 is located on and pivots about a first side of the pivot shaft 364. The first end 360 of the crank arm 358 of the second linkage 350 is located on and pivots about a second, opposite side of the pivot shaft 364. As shown in the side views of FIGS. 10-13, the crank arms 358 of the first and second linkages 348, 350 extend at opposite radial angles from the first pivot axis A.

The linear motion synchronizing mechanism 340 can optionally include a mechanical stop that prevents over-rotation of the first and second rocker arms 310. The mechanical stop can include first and second stop arms 374, 376 that are fixed to and rotate with the respective first and second rocker arms 310. The first and second stop arms 374, 376 extend at equal radial angles from the first pivot axis A. In this example, first and second fixed spring members 378, 380 are fixed to the frame 302 for engaging with the first and second stop arms 374, 376, thus preventing the noted over-rotation of the first and second rocker arms 310.

During further research and development of exercise assemblies, such as the assemblies 10, 210 and 300 shown in FIGS. 1-13, the present inventors have found that operator movement of the pair of foot pedal members 14, 304 along the noted elliptical, vertical and horizontal paths of differing dimensions provides a smooth feeling to the operator when both the foot pedals members 14, 304 and the crank members 18, 308 rotate in the same direction, i.e. when both rotate clockwise or both rotate counterclockwise. However, when the foot pedal members 14, 304 and respective crank members 18, 308 rotate in opposite directions (i.e. one rotates clockwise and one rotates counterclockwise) a non-smooth or bumpy feeling is provided to the operator. Upon recognition of this problem, the present inventors have endeavored to provide an improved exercise assembly that consistently provides a smooth feeling to the operator.

FIGS. 14-17 depict portions of such an exercise assembly 400. In most respects, the assembly 400 is constructed the same as the assembly 300 shown in FIGS. 9-13. In addition to all of the components of the assembly 300, the assembly 400 is constructed such that the pair of crank members 308 (see, e.g., FIGS. 4 and 5) are freely rotatable along the noted circular path C in a counterclockwise direction, but are restrained from rotation along the circular path C in an opposite, clockwise direction. To facilitate this function, unlike the assembly 300 shown in FIGS. 9-13, the assembly 400 includes an arm 402 that is connected to the front cross-shaft 372 by a one-way clutch 404. The one-way clutch 404 allows the front cross-shaft 372 to rotate in the counterclockwise direction with respect to the arm 402, as shown by the arrow in FIG. 16, and causes the arm 402 to rotate together with the front cross-shaft 372 in the clockwise direction, as shown by the arrows in FIG. 17. The arm 402 is rotatably fixed to the outside of the one-way clutch 404 and the front cross-shaft 372 is rotatably fixed to the inside of the one-way clutch 404. The one-way clutch 404 is configured such that the front cross-shaft 372 freely rotates with respect to the outside of the one-way clutch 404 in the counterclockwise direction, shown in FIG. 16, and such that the outside of the one-way clutch 404 engages and rotates together with the inside of the one-way clutch 404 and front cross-shaft 372 in the clockwise direction, shown in FIG. 17.

The type and construction of one-way clutch 404 can vary. For example, the one-way clutch 404 can include a conventional spring clutch or a conventional ratchetless roller clutch. One acceptable type of one-way clutch 404 is shown in exploded view in FIG. 15. The exemplary one-way clutch 404 has a collar 406, a spacer 408, a bushing or ring 410, and an inner ring 412 disposed inside of an outer ring 414. A plurality of rollers 416 are circumferentially disposed around a track on the inner ring 412. An additional spacer 418 is disposed adjacent the rollers 416, opposite the spacer 408. The inner ring 412 is keyed to the front cross-shaft 372 by a key 420, which is received in slots 422, 424 in the front cross-shaft 372 and inner ring 412, respectively. In this manner, the inner ring 412 is rotatably fixed to the front cross-shaft 372 and rotates therewith. An adapter 426 and fasteners 428 affix the one-way clutch 404 to the arm 402 such that the outer ring 414 is affixed to the arm 402 and the arm 402 rotates with the outer ring 414. Thus, rotation of the arm 402 with respect to the front cross-shaft 372 is permitted by the one-way clutch 404 in the counterclockwise direction, as discussed hereinabove. Opposite, clockwise rotation of the front cross-shaft 372 causes rotation of the arm 402, as discussed hereinabove. This functionality is facilitated by wedge-shaped friction surfaces formed on the inner surface 430 of the outer ring 414 and the rollers 416, wherein the rollers 416 are permitted to move circumferentially around the inner surface 430 in the counterclockwise direction, but are prevented by friction from moving around the inner surface 430 in the clockwise direction.

Figure 17:
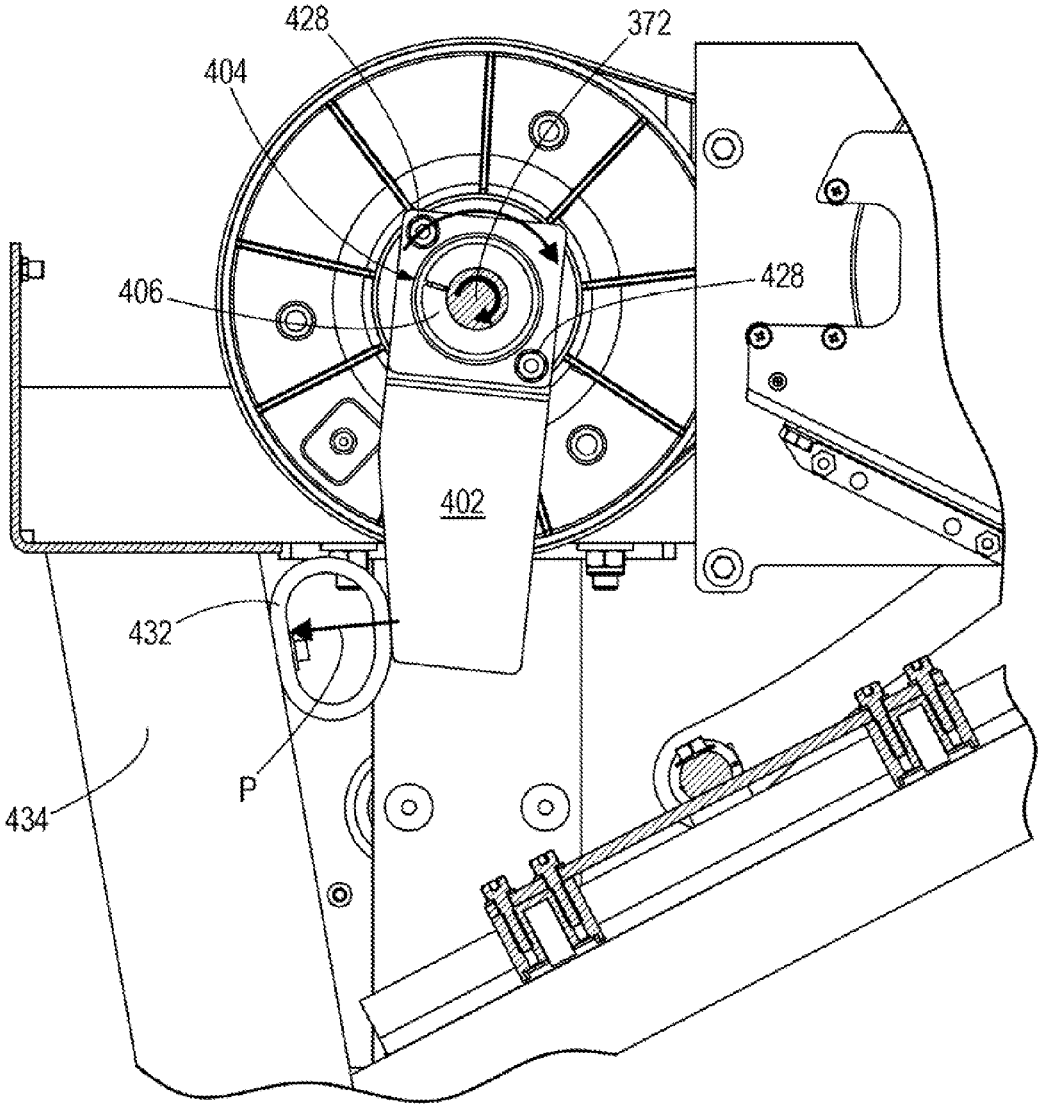

A spring 432, such as a soft spring, is located in a path of rotation P of the arm 402 in the clockwise direction such that the spring 432 and a vertical frame member 434 together block rotation of the arm 402, and thus the front cross-shaft 372, in the clockwise direction, as shown in FIG. 17. When the front cross-shaft 372 is rotated in the clockwise direction, the spring 432 is sandwiched between the vertical frame member 434 and the arm 402. The spring 432 is shown attached to the frame member 434; however in alternate embodiments the spring 432 can be attached to the arm 402. The location of attachment of the spring 432 can vary from that which is shown, as long as the spring 432 is positioned in the noted path of rotation of the arm 402 and blocks the clockwise rotation. The type of spring can vary from that which is shown and can include any type of spring that can deform under load, observe energy, reduce impact loading, and function as an end of travel or rotation limiter, such as a coil/leaf spring, a bumper, a block of metal, and/or an elastomer body.

In the embodiment described hereinabove and shown in FIGS. 4 and 5, the crank members 18 pivot in a generally circular path with respect to the foot pedal members 14 and coupler arms 16, as shown by the arrow C. The movement shown at line C occurs in both clockwise and counterclockwise directions. In contrast, the assembly 400 shown in FIGS. 14-17 prevents free rotational movement of the crank members 18, 308 in the clockwise direction. This ensures that the operator will consistently receive a smooth feeling when the foot pedal members 14, 304 are moved in a forward stride by the operator, because the foot pedal members 14, 304 and crank members 18, 308 will rotate in the same direction, i.e. both counterclockwise during forward movement of the foot pedal members 14, 304. More specifically, when the operator causes forward cyclical motion of the foot pedal members 14, 304, the one-way clutch 404 will only allow crank members 18, 308 to rotate in the same direction, i.e. counterclockwise. Even more specifically, rotation of the crank members 18, 308 causes rotation of the respective timing belts 80, 334 via the through-shaft assemblies 332. Such rotation of the crank members 18, 308 causes rotation of the lower timing pulleys 84. The timing belts 80, 334 are fixedly, rotatably connected at their upper ends to the opposing ends 76, 78 of the front cross-shaft 372 such that rotation of the timing belts 80, 334 causes rotation of the front cross-shaft 372, which is limited by the one-way clutch 404 as described hereinabove. Connection between the timing belts 80, 334 and the front cross-shaft 372 is facilitated by the pair of upper timing pulleys 86. Upper timing pulleys 86 are connected to one end of the front cross-shaft 372 and transfer rotational movement of the respective timing belts 80, 334 to the front cross-shaft 372 in the manner described hereinabove with respect to the embodiments shown in FIGS. 1-13.

In alternate embodiments, the assembly 400 can include two or more one-way clutches that alternately operate to allow/prevent rotation of the crank members 18, 308 in the clockwise and counterclockwise directions. The one-way clutches can be selectively operated by the operator to provide common rotation of the foot pedal members 14, 304 and crank members 18, 308 in the clockwise or counterclockwise directions. The one-way clutches can be selectively operated by an input device, such as the input device on the control screen shown in FIG. 1, wherein the operator can input a user-intended exercise motion about the noted user-defined paths. In such an embodiment, the assembly 400 can include a control circuit that controls operation of the one or more clutches via for example a solenoid, to prevent and allow rotation in the noted clockwise and counterclockwise directions. In further examples, the one-way clutch does not have to be located on the front cross-shaft 372, but instead could be located on any live member that transfers rotational movement between the crank members 18, 308 and the resistance device.

The present disclosure thus provides means for controlling movement of the pair of crank members 18, 308 such that the pair of crank members 18, 308 are freely movable along the circular path C in a first direction and restrained from rotation along the circular path C in a second, opposite direction. The means for controlling movement can include the noted arm 402, one-way clutch 404 and optionally the spring 432, which interacts with the vertical frame member 434. These devices are operably connected to the crank members 18, 308, as described hereinabove.

What is claimed is:

1. An exercise assembly, the assembly comprising:

a frame;

a pair of elongated foot pedal members, each food pedal member having a front portion and a rear portion;

a pair of elongated coupler arms, each coupler arm having a lower portion and having an upper portion that is pivotally connected to the frame;

a pair of crank members, each crank member having a first portion that is pivotally connected to the front portion of one of the pair of foot pedal members and having a second portion that is pivotally connected to the lower portion of one of the pair of coupler arms, such that each crank member is rotatable in a circular path;

a pair of elongated rocker arms, each rocker arm having a lower portion that is pivotally connected to one of the pair of foot pedal members in between the foot pad and the crank member and having an upper portion that is pivotally connected to the frame;

wherein the pair of foot pedal members are each movable along user-defined paths of different dimensions; and a front cross-shaft, wherein the pair of crank members are operatively connected to the front cross-shaft such that movement of each of the pair of crank members along the circular path causes rotation of the front cross-shaft;

wherein the pair of crank members are freely rotatable along the circular path in a first direction and restrained from rotation along the circular path in a second, opposite direction.

2. The exercise assembly according to claim 1, comprising an arm that is connected to the front cross-shaft so that the front cross-shaft is free to rotate in the first direction with respect to the arm, and so that the arm rotates with the front cross-shaft in the second direction.

3. The exercise assembly according to claim 2, comprising a one-way clutch connecting the arm to the front cross-shaft, wherein the arm is rotatably fixed to the one-way clutch.

4. The exercise assembly according to claim 3, comprising a spring located in a path of rotation of the arm, wherein the spring and frame prevent rotation of the arm in the second direction.

5. The exercise assembly according to claim 4, wherein the spring is sandwiched between the frame and the arm when the arm rotates in the second direction.

6. The exercise assembly according to claim 5, wherein the spring is attached to the frame.

7. The exercise assembly according to claim 1, wherein the first direction is counter-clockwise and wherein the second direction is clockwise.

8. The exercise assembly according to claim 1, comprising a pair of timing belts, each timing belt being connected to the second portion of one of the pair of crank members, such that movement of each of the pair of crank members along the circular path causes rotation of the respective timing belt.

9. The exercise assembly according to claim 8, comprising a pair of lower timing pulleys, each lower timing pulley being connected to one of the pair of crank members and transferring rotational movement of the respective crank member to the timing belt.

10. The exercise assembly according to claim 9: wherein each timing belt is connected to an opposite end of the front cross-shaft such that rotation of each timing belt causes rotation of the front cross-shaft.

11. The exercise assembly according to claim 10, comprising a pair of upper timing pulleys, each upper timing pulley being connected to one end of the front cross-shaft and transferring rotational movement of a respective timing belt to the front cross-shaft.

12. The exercise assembly according to claim 1, wherein the front cross-shaft connects the upper portions of the pair of coupler arms to the frame.

13. The exercise assembly according to claim 1, comprising a pair of foot pads, each foot pad being disposed on the rear portion of the one of the pair of foot pedal members.

14. An exercise assembly, the assembly comprising:

a frame;

a pair of elongated foot pedal members, each food pedal member having a front portion and a rear portion;

a pair of elongated coupler arms, each coupler arm having a lower portion and having an upper portion that is pivotally connected to the frame;

a pair of crank members, each crank member having a first portion that is pivotally connected to the front portion of one of the pair of foot pedal members and having a second portion that is pivotally connected to the lower portion of one of the pair of coupler arms, such that each crank member is rotatable in a circular path;

a pair of elongated rocker arms, each rocker arm having a lower portion that is pivotally connected to one of the pair of foot pedal members in between the foot pad and the crank member and having an upper portion that is pivotally connected to the frame;

wherein the pair of foot pedal members are each movable along user-defined paths of different dimensions;

a front cross-shaft, wherein the pair of crank members are operatively connected to the front cross-shaft such that movement of each of the pair of crank members along the circular path causes rotation of the front cross-shaft; and at least one clutch preventing rotation of at least one of the crank members in at least one of a first direction along the circular path and an opposite, second direction along the circular path.

15. The exercise assembly according to claim 14, comprising an input device that inputs a user-intended exercise motion about the user-defined paths, and control circuit that controls the at least one clutch to prevent and allow rotation in the first direction and second direction, respectively.

16. An exercise assembly, the assembly comprising:

a frame;

a pair of elongated foot pedal members, each food pedal member having a front portion and a rear portion;

a pair of elongated coupler arms, each coupler arm having a lower portion and having an upper portion that is pivotally connected to the frame;

a pair of crank members, each crank member having a first portion that is pivotally connected to the front portion of one of the pair of foot pedal members and having a second portion that is pivotally connected to the lower portion of one of the pair of coupler arms, such that each crank member is rotatable in a circular path;

a pair of elongated rocker arms, each rocker arm having a lower portion that is pivotally connected to one of the pair of foot pedal members in between the foot pad and the crank member and having an upper portion that is pivotally connected to the frame;

wherein the pair of foot pedal members are each movable along user-defined paths of different dimensions;

a front cross-shaft, wherein the pair of crank members are operatively connected to the front cross-shaft such that movement of each of the pair of crank members along the circular path causes rotation of the front cross-shaft;

means for controlling movement of the pair of crank members such that the pair of crank members are freely rotatable along the circular path in a first direction and restrained from rotation along the circular path in a second, opposite direction.

17. The exercise assembly according to claim 16, wherein the means comprises an arm that is connected to the front cross-shaft so that the front cross-shaft freely rotates in the first direction with respect to the arm, and such that the arm rotates with the front cross-shaft in the second direction.

18. The exercise assembly according to claim 17, wherein the means comprises a one-way clutch connecting the arm to the front cross-shaft, wherein the arm is rotatably fixed to the one-way clutch.

19. The exercise assembly according to claim 18 wherein the means comprises a spring located in a path of rotation of the arm, wherein the spring and frame prevents rotation of the arm in the second direction.

20. The exercise assembly according to claim 19, wherein the means comprises spring is sandwiched between the frame and the arm when the arm rotates in the second direction.

* * * * *

UNITED STATES PATENT AND TRADEMARK OFFICE

CERTIFICATE OF CORRECTION

PATENT NO. : 9,114,275 B2
APPLICATION NO. : 14/095368
DATED : August 25, 2015
INVENTOR(S) : Zhi Lu, Thomas J. Danowski and Mark C. Termion It is certified that error appears in the above-identified patent and that said Letters Patent is hereby corrected as shown below:

Claims

In claim 1, at column 11, line 46, “food” should instead read --foot--.

In claim 1, at column 11, line 47, after “front portion” insert --having a pivot axis--.

In claim 1, at column 11, line 56, after “path” insert --about a respective said pivot axis--.

In claim 14, at column 12, line 52, “food” should instead read --foot--.

In claim 14, at column 12, line 53, after “front portion” insert --having a pivot axis--.

In claim 14, at column 12, line 62, after “path” insert --about a respective said pivot axis--.

In claim 16, at column 13, line 19, “food” should instead read --foot--.

In claim 16, at column 13, line 20, after “front portion” insert --having a pivot axis--.

In claim 16, at column 13, line 29, after “path” insert --about a respective said pivot axis--.

Signed and Sealed this
Twenty-second Day of December, 2015

Michelle K. Lee

Michelle K. Lee
*Director of the United States Patent and Trademark Office*